US008610654B2

(12) United States Patent
Kerofsky et al.

(10) Patent No.: US 8,610,654 B2
(45) Date of Patent: Dec. 17, 2013

(54) CORRECTION OF VISIBLE MURA DISTORTIONS IN DISPLAYS USING FILTERED MURA REDUCTION AND BACKLIGHT CONTROL

(75) Inventors: Louis Joseph Kerofsky, Camas, WA (US); Yasuo Ozawa, Vancouver, WA (US)

(73) Assignee: Sharp Laboratories of America, Inc., Camas, WA (US)

( * ) Notice: Subject to any disclaimer, the term of this patent is extended or adjusted under 35 U.S.C. 154(b) by 843 days.

(21) Appl. No.: 12/459,502

(22) Filed: Jul. 2, 2009

(65) Prior Publication Data

US 2010/0013751 A1 Jan. 21, 2010

Related U.S. Application Data

(63) Continuation-in-part of application No. 12/218,817, filed on Jul. 18, 2008.

(51) Int. Cl.

| | |
|---|---|
| ***G09G 3/36*** | (2006.01) |
| ***G09G 5/00*** | (2006.01) |
| ***G09G 5/02*** | (2006.01) |
| ***G09G 5/10*** | (2006.01) |

(52) U.S. Cl.

USPC ..... 345/89; 345/3.4; 345/87; 345/102; 345/601; 345/690; 348/180

(58) Field of Classification Search

USPC ..... 345/89

See application file for complete search history.

(56) References Cited

U.S. PATENT DOCUMENTS

| | | | | |
|---|---|---|---|---|
| 2003/0214586 | A1* | 11/2003 | Lee et al. | 348/180 |
| 2004/0113906 | A1 | 6/2004 | Lew et al. | |
| 2004/0257318 | A1 | 12/2004 | Itoh | |
| 2005/0007392 | A1* | 1/2005 | Kasai et al. | 345/690 |
| 2005/0099431 | A1* | 5/2005 | Herbert et al. | 345/601 |
| 2006/0202945 | A1* | 9/2006 | Feng | 345/102 |
| 2007/0132661 | A1* | 6/2007 | Shen et al. | 345/3.4 |
| 2008/0150853 | A1* | 6/2008 | Peng et al. | 345/87 |

FOREIGN PATENT DOCUMENTS

| | | |
|---|---|---|
| EP | 1650730 | 4/2006 |

* cited by examiner

*Primary Examiner* — Charles V Hicks

(74) *Attorney, Agent, or Firm* — Chernoff Vilhauer McClung & Stenzel, LLP

(57) ABSTRACT

A display that includes at least one gray level being provided to a plurality of pixels that illuminates each of the pixels with the gray level. The display applies interpolated corrective data for the pixels so as to reduce the mura effects of said display and modifies the backlight of the display.

25 Claims, 27 Drawing Sheets

Block diagram of flexible mura correction system

Modern LCD display and sources of Mura

Loading correction Mura tonescales in to display memory (brute-force method)

Using the display for normal input imagery and the loaded Mura correction tonescale LUT. (brute-force method)

CSF dependence on viewing angle.
Measurements by Carlson[6] at a luminance of 108cd/m$^2$.

CSF of the human visual system

Using a 2D CSF model to attenuate the Mura correction for maintaining a higher dynamic range after correction Example signal effects of invention:
left = brute force method and loss of dynamic range,
right = CSF-filtered approach Original luminance (no correction)

Brute-force correction

Single image correction

Δcv curve of single image correction

Δcv curve of brute-force correction

Original luminance (no correction)

Multiple image correction (e.g. target gray scale = 2)

Δcv curve of multiple image correction

Block diagram of flexible mura correction system

METHOD OF COMPENSATING BRIGHTNESS LOSS AND CONSTRAINT

OFF-LINE TONE SCALE DESIGN

ON-LINE TONE SCALE MAPPING

RELATED IMAGES AND DISPLAYS

MINIMUM DISTORTION BACKLIGHT DETERMINATION

FIG. 29
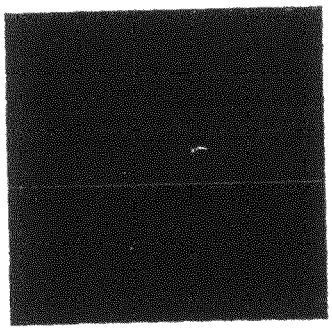
Figure 1 Black
FIG. 30
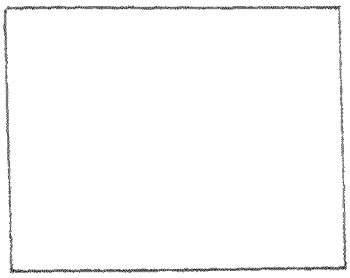
Figure 2 White
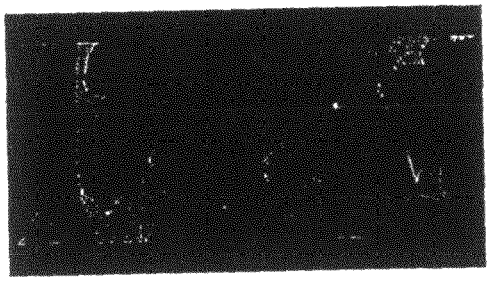
Figure 3 Dim
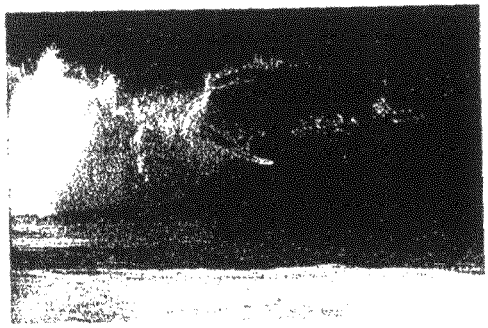
Figure 4 Bright
FIG. 31
FIG. 32

BACKLIGHT POWER VERSUS DISTORTION

COMBINATION OF BACKLIGHT MODULATION AND MURA CORRECTIOON

IMPROVED MURA CORRECTION COMBINATION

AREA ACTIVE BL WITH MURA CORRECTIONO

CORRECTION OF VISIBLE MURA DISTORTIONS IN DISPLAYS USING FILTERED MURA REDUCTION AND BACKLIGHT CONTROL

CROSS-REFERENCE TO RELATED APPLICATIONS

This application is a continuation-in-part of U.S. patent application Ser. No. 12/218,817, filed Jul. 18, 2008.

BACKGROUND OF THE INVENTION

The present invention relates to a system for reducing mura defects in a displayed image in an efficient manner.

The number of liquid crystal displays, electroluminescent displays, organic light emitting devices, plasma displays, and other types of displays are increasing. The increasing demand for such displays has resulted in significant investments to create high quality production facilities to manufacture high quality displays. Despite the significant investment, the display industry still primarily relies on the use of human operators to perform the final test and inspection of displays. The operator performs visual inspections of each display for defects, and accepts or rejects the display based upon the operator's perceptions. Such inspection includes, for example, pixel-based defects and area-based defects. The quality of the resulting inspection is dependent on the individual operator which are subjective and prone to error.

"Mura" defects are contrast-type defects, where one or more pixels is brighter or darker than surrounding pixels, when they should have uniform luminance. For example, when an intended flat region of color is displayed, various imperfections in the display components may result in undesirable modulations of the luminance. Mura defects may also be referred to as "Alluk" defects or generally non-uniformity distortions. Generically, such contrast-type defects may be identified as "blobs", "bands", "streaks", etc. There are many stages in the manufacturing process that may result in mura defects on the display.

Mura defects may appear as low frequency, high-frequency, noise-like, and/or very structured patterns on the display. In general, most mura defects tend to be static in time once a display is constructed. However, some mura defects that are time dependent include pixel defects as well as various types of non-uniform aging, yellowing, and burn in. Display non-uniformity deviations that are due to the input signal (such as image capture noise) are not considered mura defects.

Referring to FIG. 1, mura defects from an input image 170 which is adjusted in its tone scale 160 may occur as a result of various components of the display. The combination of the light sources (e.g., fluorescent tubes or light emitting diodes) and the diffuser 150 results in very low frequency modulations as opposed to a uniform field in the resulting displayed image. The LCD panel itself may be a source of mura defects because of non-uniformity in the liquid crystal material deposited on the glass. This type of mura tends to be low frequency with strong asymmetry, that is, it may appear streaky which has some higher frequency components in a single direction. Another source of mura defects tends to be the driving circuitry 120, 130, 140 (e.g., clocking noise) which causes grid like distortions on the display. Yet another source of mura defects is pixel noise, which is primarily due to variations in the localized driving circuitry (e.g., the thin film transistors) and is usually manifested as a fixed pattern noise.

The foregoing and other objectives, features, and advantages of the invention will be more readily understood upon consideration of the following detailed description of the invention, taken in conjunction with the accompanying drawings.

BRIEF DESCRIPTION OF THE SEVERAL VIEWS OF THE DRAWINGS

FIG. 29 illustrates a black frame.

FIG. 30 illustrates a white frame.

FIG. 31 illustrates a dim frame.

FIG. 32 illustrates a bright frame.

DETAILED DESCRIPTION OF PREFERRED EMBODIMENT

Figure 1:
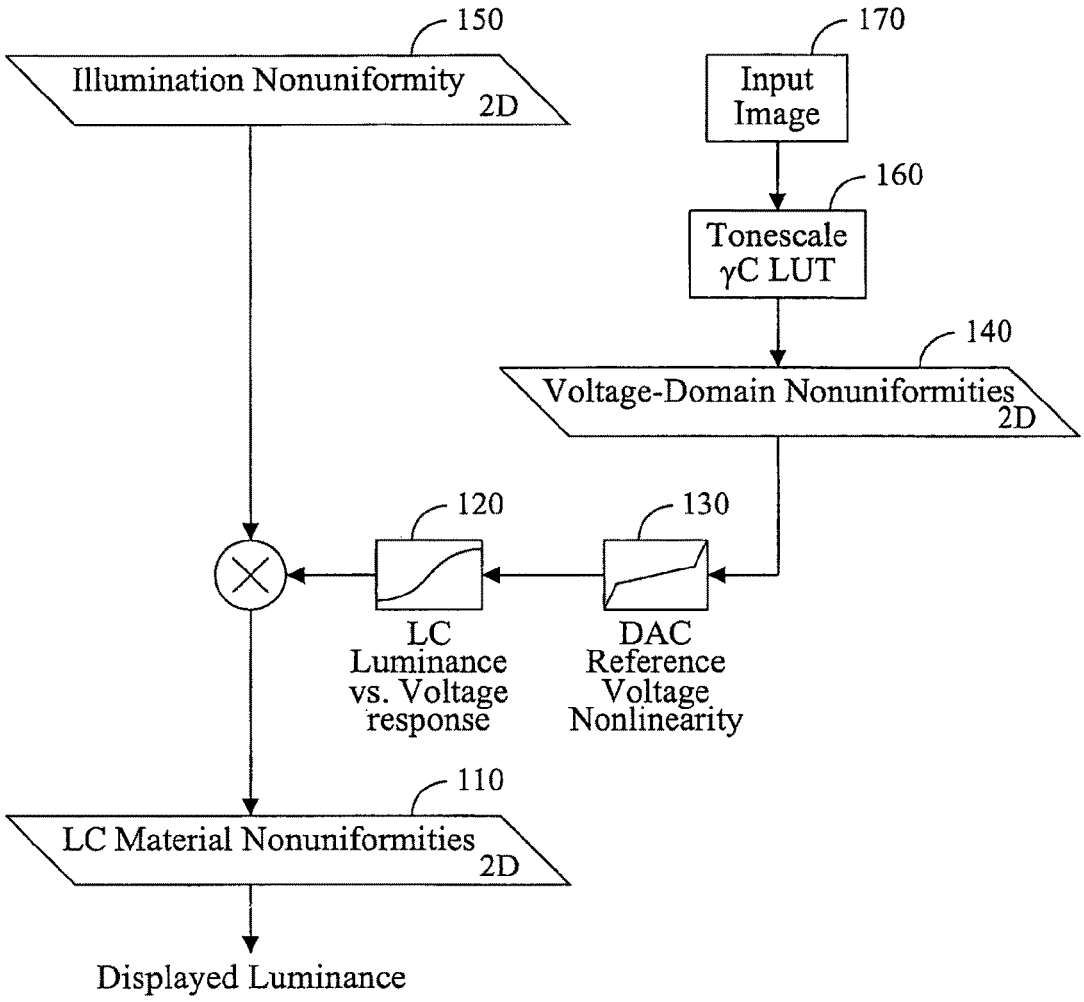
FIG. 1 illustrates liquid crystal devices and sources of mura.

The continual quality improvement in display components reduces mura defects but unfortunately mura defects still persist even on the best displays. Referring to FIG. 1, identification of mura defects is not straightforward because the source of the mura arise in different luminance domains. The mura resulting from the illumination source occurs in the linear luminance domain. To compensate for this effect from the linear domain, the LCD luminance image is divided by the mura and then re-normalized to the desired maximum level. This effect in the linear domain may also be compensated by addition in the log domain. Unfortunately, the data displayed on the image domain of the image in the LCD code value space is neither linear nor log luminance. Accordingly, for correction of illumination-based mura, the LCD image data should be converted to either of these domains for correction.

The mura defects due to the thin film transistor noise and driver circuits does not occur in the luminance domain, but rather occurs in the voltage domain. The result manifests itself in the LCD response curse which is usually an S-shaped function of luminance.

Variations in the mura effect due to variations in liquid crystal material occur in yet another domain, depending on if it is due to thickness of the liquid crystal material, or due to its active attenuation properties changing across the display.

Rather than correct for each non-uniformity in their different domains, a more brute-force approach is to measure the resulting tone scale for each pixel of the display. The low frequency mura non-uniformities as well as the higher frequency fixed pattern mura non-uniformity will appear as distortions in the displayed tone scale. For example, additive distortions in the code value domain will show up as vertical offsets in the tone scale's of the pixels affected by such a distortion. Illumination based distortions which are additive in the log domain will show up as non-linear additions in the tone scale. By measuring the tone scale per pixel, where the tone scale is a mapping from code value to luminance, the system may reflect the issues occurring in the different domains back to the code value domain. If each pixel's tonescale is forced to be identical (or substantially so), then at each gray level all of the pixels will have the same luminance (or substantially so), thus the mura will be reduced to zero (or substantially so).

Figure 2:
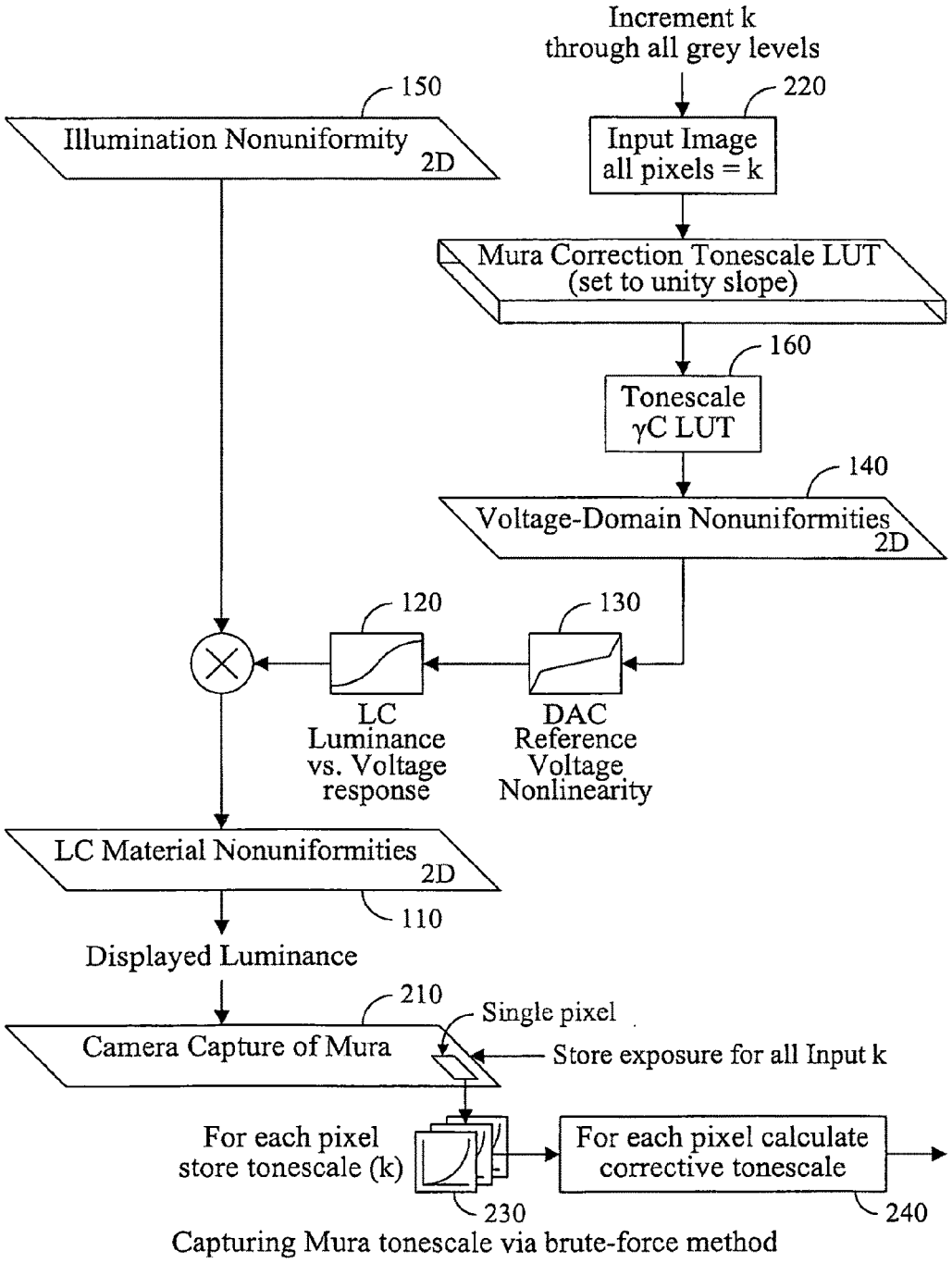
FIG. 2 illustrates capturing mura tonescale.
Figure 3:
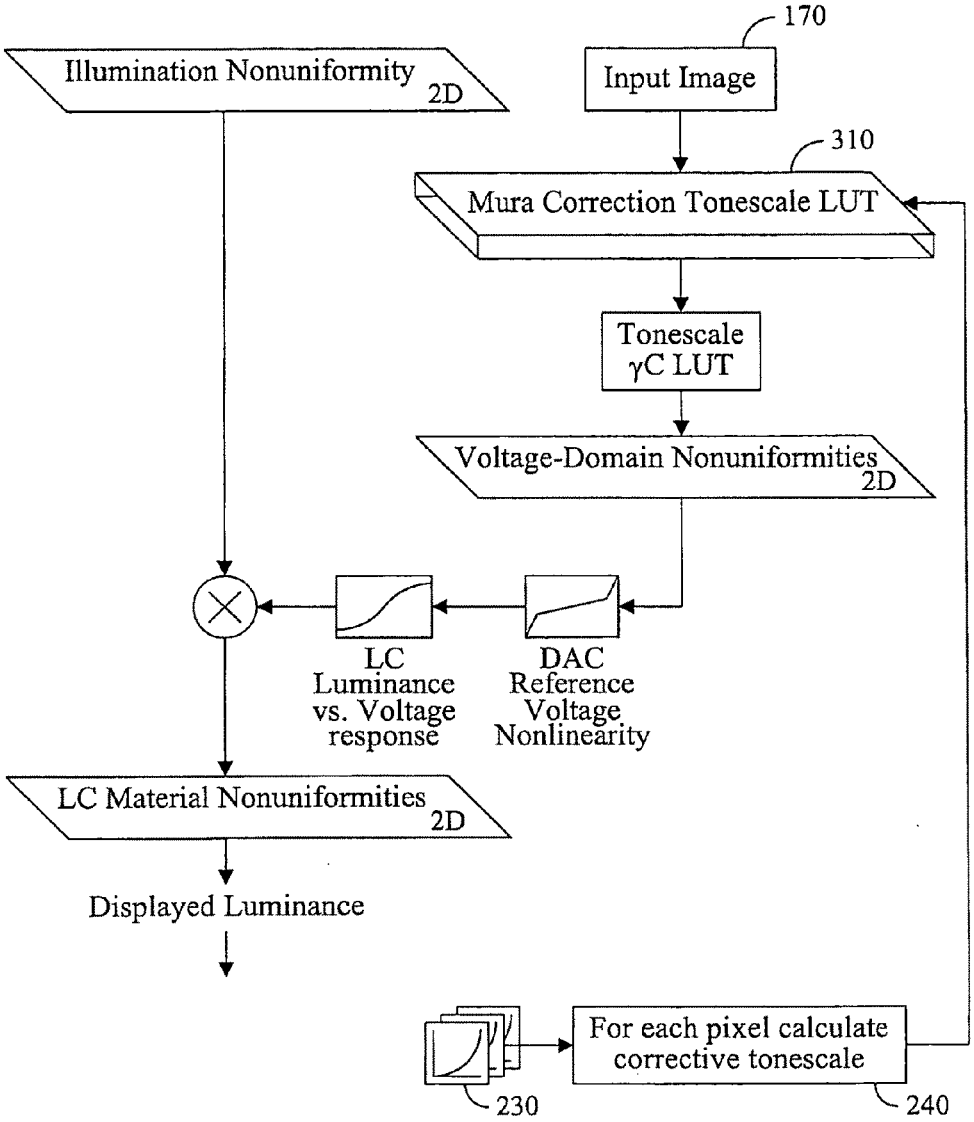
FIG. 3 illustrates loading correction mura tonescales.

In summary, referring to FIG. 2, the process of detecting and correcting for mura defects may be done as a set of steps. First for a uniform test input image 220, the capture and generation of the corrective tone scale 230, 240 is created which may be expressed in the form of a look up table. Second, referring to FIG. 3 the corrective tone scale may be applied to a mura look up table 310 which operates on the frame buffer memory of the display. Third, referring to FIG. 4, the display is used to receive image data 170 which is modified by the mura look up table 310, prior to being displayed on the display.

The first step may use an image capture device, such as a camera, to capture the mura as a function of gray level. The camera should have a resolution equal to or greater than the display so that there is at least one pixel in the camera image corresponding to each display pixel. For high resolution displays or low resolution cameras, the camera may be shifted in steps across the display to characterize the entire display. The preferable test patterns provided to and displayed on the display include uniform fields (all code values=k) and captured by the camera. The test pattern and capture are done for all of the code values of the displays tone scale (e.g., 256 code values for 8 bit/color display). Alternatively, a subset of the tone scales may be used, in which case typically the non-sampled tone values are interpolated.

Figure 4:
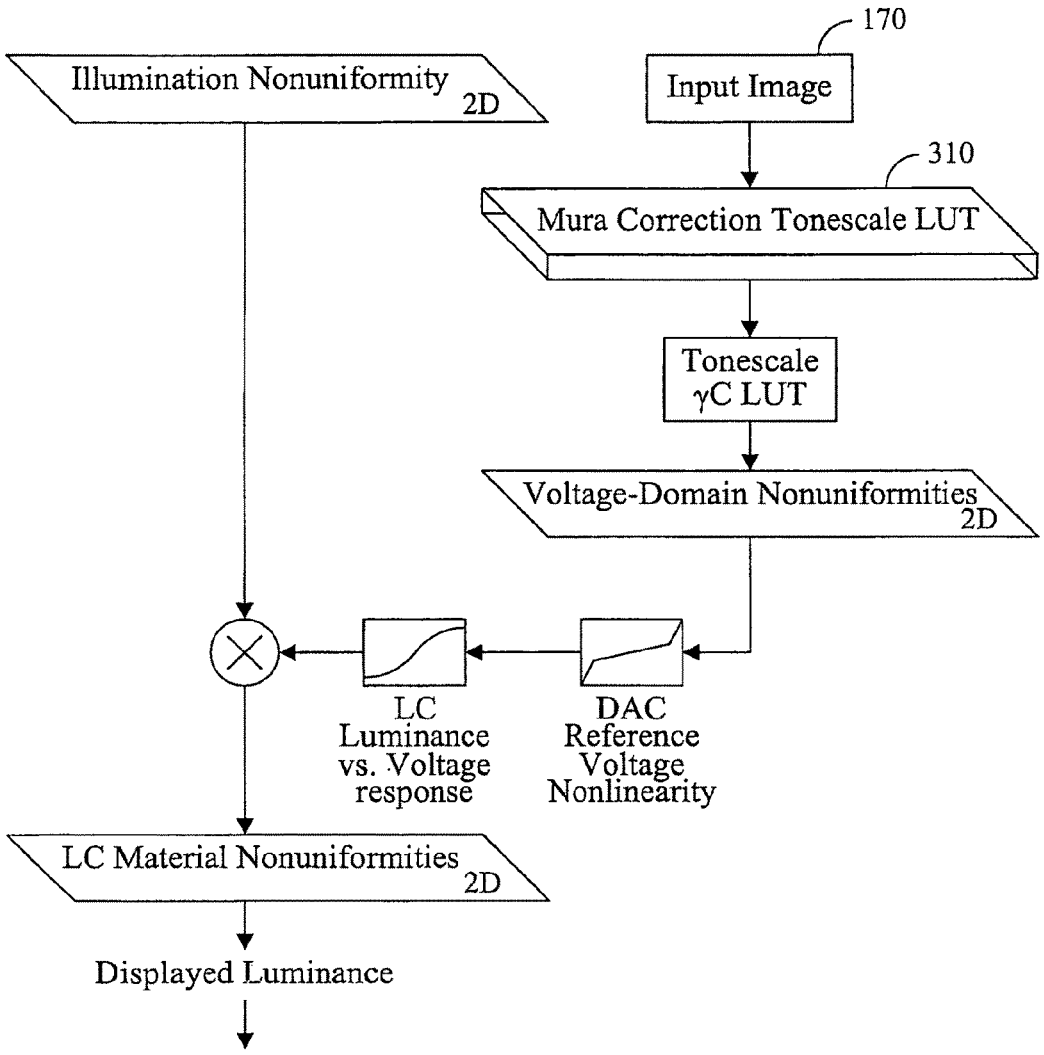
FIG. 4 illustrates input imagery and loaded mura correction tonescale.

The captured images are combined so that a tone scale across its display range is generated for each pixel (or a sub-set thereof). If the display has zero mura, then the corrective mura tone scales would all be the same. A corrective tone scale for each pixel is determined so that the combination of the corrective tone scale together with the system non-uniformity provides a resulting tone scale that is substantially uniform across the display. Initially, the values in the mura correction tone scale look up table may be set to unity before the display is measured. After determining the corrective mura tone scale values for each pixel, it is loaded into the display memory as shown in FIG. 4. With the mura corrective tone scale data loaded any flat field will appear uniform, and even mura that may be invisible on ramped backgrounds, such as a sky gradient, will be set to zero.

While this mura reduction technique is effective for reducing display non-uniformities, it also tends to reduce the dynamic range, namely, the maximum to minimum in luminance levels. Moreover, the reduction in the dynamic range also depends on the level of mura which varies from display to display, thus making the resulting dynamic range of the display variable. For example, the mura on the left side of the display may be less bright than the mura on the right side of the display. This is typical for mura due to illumination non-uniformity, and this will tend to be the case for all gray levels. Since the mura correction can not make a pixel brighter than its max, the effect of mura correction is to lower the luminance of the left side to match the maximum value of the darker side. In addition, for the black level, the darker right side can at best match the black level of the lighter left side. As a result, the corrected maximum gets reduced to the lowest maximum value across the display, and the corrected minimum gets elevated to the lightest minimum value across the display. Thus, the dynamic range (e.g., log max-log min) of the corrected display will be less than either the range of the left or right sides, and consequently it is lower than the uncorrected display. The same reduction in dynamic range also occurs for the other non-uniformities. As an example, a high amplitude fixed pattern noise leads to a reduction of overall dynamic range after mura correction.

The technique of capturing the mura from the pixels and thereafter correcting the mura using a look up table may be relatively accurate within the signal to noise ratio of the image capture apparatus and the bit-depth of the mura correction look up table. However, it was determined that taking into account that actual effects of the human visual system that will actually view the display may result in a greater dynamic range than would otherwise result.

By way of example, some mura effects of particular frequencies are corrected in such a manner that the changes may not be visible to the viewer. Thus the dynamic range of the display is reduced while the viewer will not otherwise perceive a difference in the displayed image. By way of example, a slight gradient across the image so that the left side is darker than the right side may be considered a mura effect. The human visual system has very low sensitivity to such a low frequency mura artifact and thus may not be sufficiently advantageous to remove. That is, it generally takes a high amplitude of such mura waveforms to be readily perceived by the viewer. If the mura distortion is generally imperceptible to the viewer, although physically measurable, then it is not useful to modify it.

Figure 5:
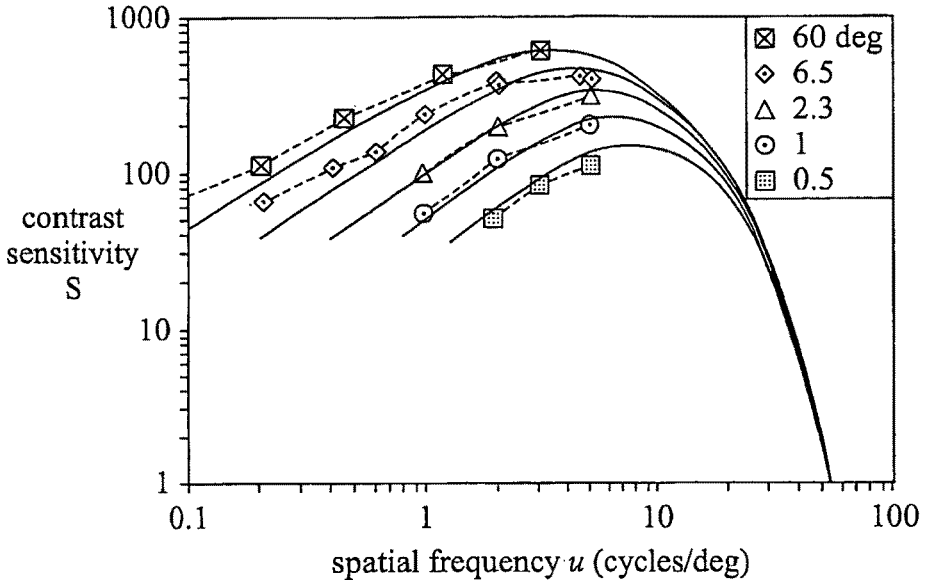
FIG. 5 illustrates contrast sensitivity function dependence on viewing angle.

Referring to FIG. 5, one measure of the human visual system is a contrast sensitivity function (CSF) of the human eye. This is one of several criteria that may be used so that only the mura that is readily visible to the eye is corrected. This has the benefit of maintaining a higher dynamic range of the correction than the technique illustrated in FIGS. 3-5.

The CSF of the human visual system as a function of spatial frequencies and thus should be mapped to digital frequencies for use in mura reduction. Such a mapping is dependent on the viewing distance. The CSF changes shape, maximum sensitivity, and bandwidth is a function of the viewing conditions, such as light adaptation level, display size, etc. As a result the CSF should be chosen for the conditions that match that of the display and its anticipated viewing conditions.

The CSF may be converted to a point spread function (psf) and then used to filter the captured mura images via convolution. Typically, there is a different point spread function for each gray level. The filtering may be done by leaving the CSF in the frequency domain and converting the mura images to the frequency domain for multiplication with the CSF, and then convert back to the spatial domain via inverse Fourier transform.

Figure 6:
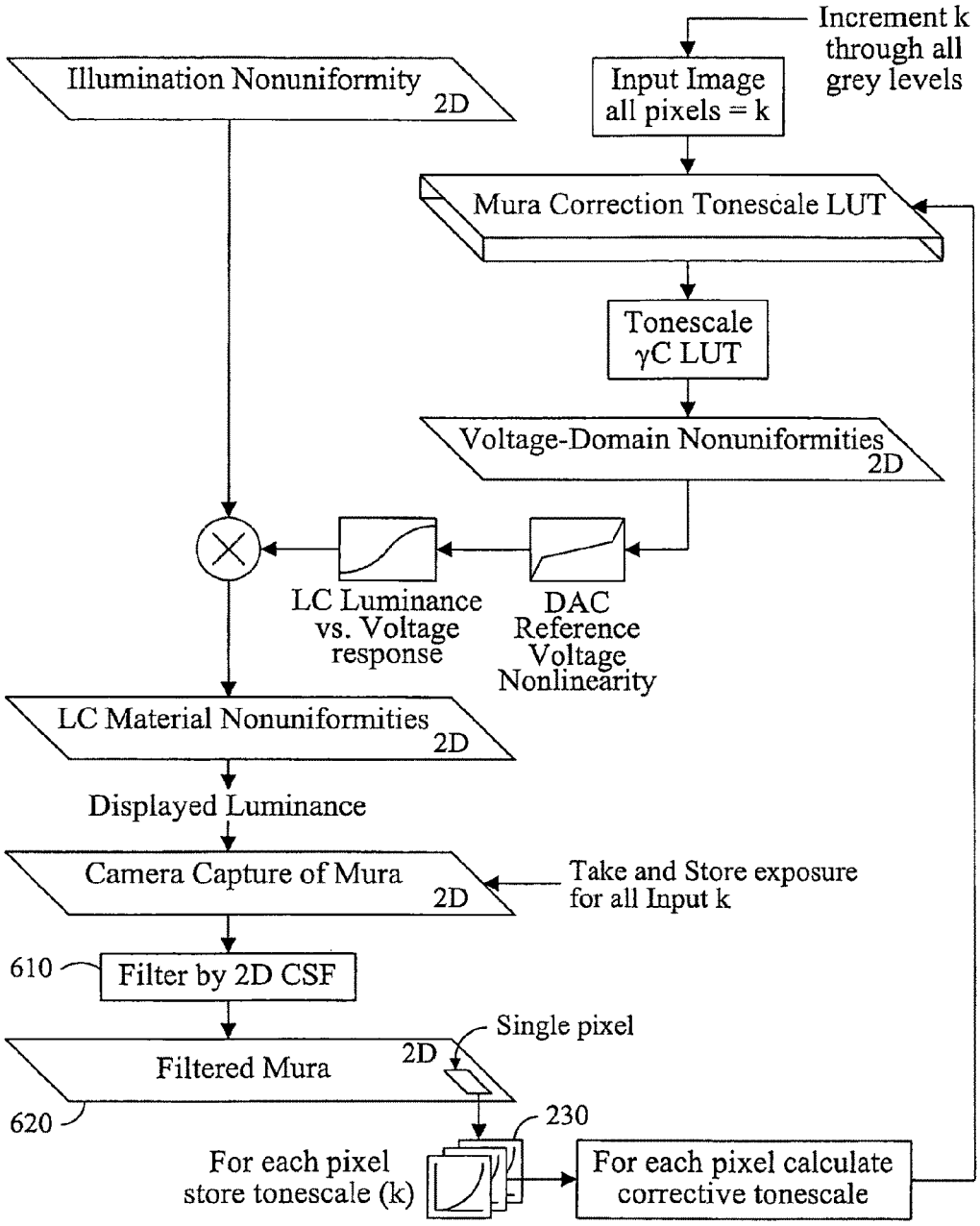
FIG. 6 illustrates a contrast sensitivity model to attenuate the mura correction to maintain a higher dynamic range.
Figure 7:
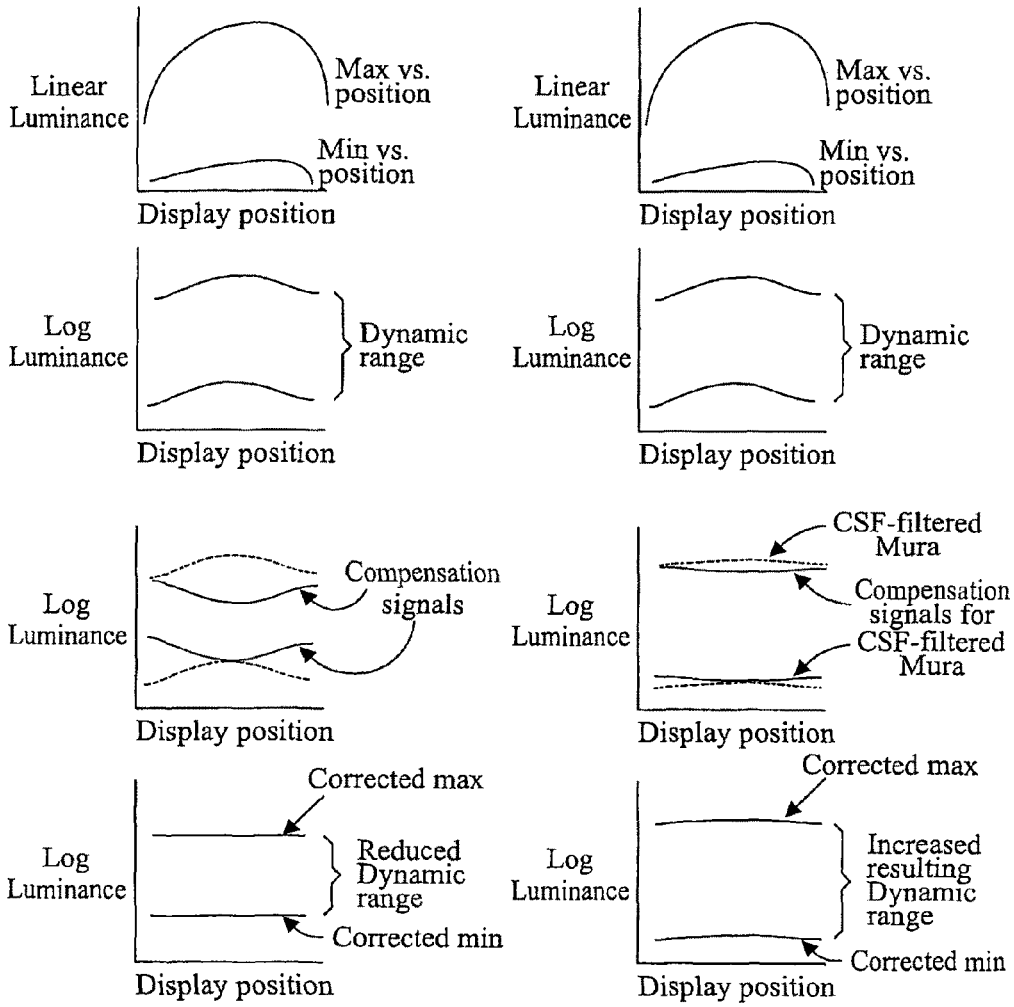
FIG. 7 illustrates examples of mura correction with and without using the contrast sensitivity model.

Referring to FIG. 6, a system that includes mura capture, corrective mura tone scale calculation, CSF filtered 610, 620, and mura correction tone scale look up table is illustrated. FIG. 7 illustrates the effects of using the CSF to maintain bandwidth.

Figure 8:
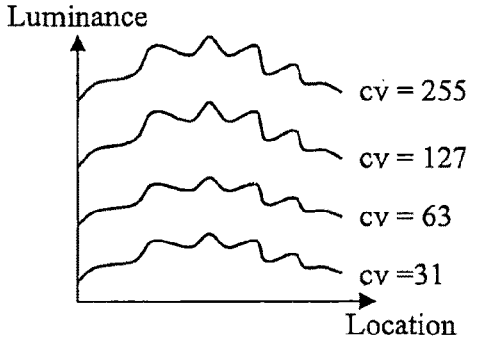
FIG. 8 illustrates an original luminance without correction.
Figure 9:
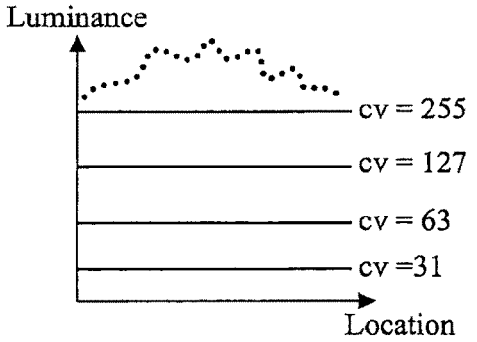
FIG. 9 illustrates brute-force mura correction.

It is possible to correct for mura distortions at each and every code value which would be approximately 255 different sets of data for 8-bit mura correction. Referring to FIG. 8, the luminance at each code value is illustrated for a selected set of code values across the display. In many displays, the luminance toward the edges of the display tend to be lower than the center of the display. This may be, in part, because of edge effects of the display. Referring to FIG. 9, a brute-force mura correction technique for each and every code value for all pixels of the display results in a straight line luminance for each code value across the display. It is noted that the resulting luminance for a particular code value is selected to be the minimum of the display. Accordingly, it was observed that in the event that a particular region of the display has values substantially lower than other regions of the display, the result will be a decrease in the luminance provided from the display for a particular code value, in order to have a uniform luminance across the display.

Figure 10:
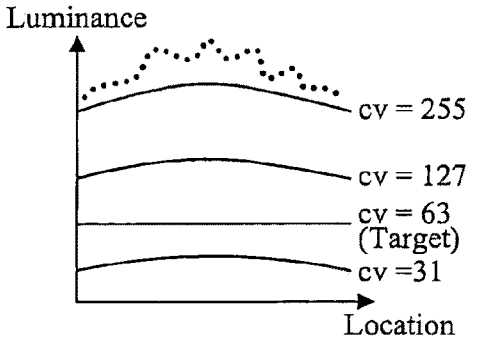
FIG. 10 illustrates single image mura correction.

Referring to FIG. 10, to increase the dynamic range for portions of the display, it is desirable to determine a mura correction for a particular code value, such as code value 63. Thus at code value 63 the resulting mura across the display will be corrected or substantially corrected. The mapping used to correct for code value 63 is then used at the basis for the remaining code values to determine an appropriate correction. The resulting code values will tend to result in arched mura correction curves. The resulting curved mura curves result in an increase in the dynamic range of regions of the display while displaying values in a manner that are difficult to observe mura defects.

In some cases, it is desirable to determine a mura correction for a particular code value, such as code value 63, that includes a curve as the result of filtering. The filtering may be a low pass filter, and tends to be bulged toward the center. The curved mura correction tends to further preserve the dynamic range of the display. The curved mura correction may likewise be used to determine the mura correction for the remaining code values.

It is to be understood, that the mura correction may further be based upon the human visual system. For example, one or more of the mura curves that are determined may be based upon the human visual system. Moreover, the low pass filtered curve may be based upon the human visual system. Accordingly, any of the techniques described herein may be based in full, or in part, on the human visual system.

The memory requirements to correct for mura for each and every gray level requires significant computational resources. Additional approaches for correcting mura are desirable. One additional technique is to use a single image correction technique that uses fewer memory resources, and another technique is to use a multiple image correction technique which uses fewer memory resources with improved mura correction. The implementation of the conversion from the original input images to mura corrected output images should be done in such a manner that enables flexibility, robustness, and realizes efficient creation of corrected output images by using interpolation.

The single image correction is a mura correction technique that significantly reduces the memory requirements. Comparing with brute-force correction, single image correction corrects the mura of just only one gray level (e.g. cv=63 in FIGS. 4, 5, 6) instead of every gray level of the brute-force correction. Brute-force correction intends to correct every gray level for all pixels. FIG. 9 shows only several gray levels for simplicity of illustration.

Figure 11:
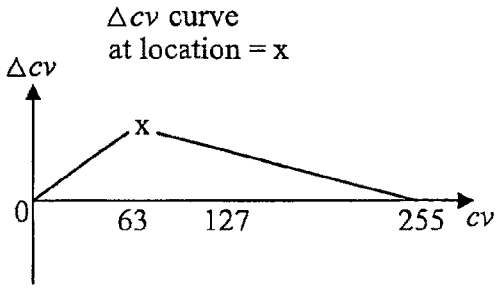
FIG. 11 illustrates a delta curve for a single image mura correction.
Figure 12:
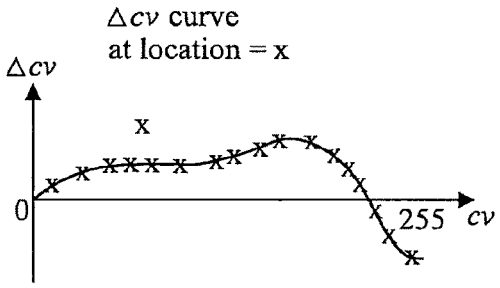
FIG. 12 illustrates a delta curve for a brute force mura correction.

In particular, in single image correction the correction code value ($\Delta cv$) of other gray levels without the target to correct are determined by interpolation assuming $\Delta cv=0$ at gray level is 0 (lower limitation) and 255 (upper limitation) because mura of intermediate gray levels is more visible, as illustrated in FIG. 11. On the other hand, brute-force method calculates the correction code value of all of gray levels, theoretically speaking, as illustrated in FIG. 12. In some cases, it is desirable to also provide white mura correction ($\Delta cv=255$), in addition to intermediate grey levels, to provide increased uniformity.

Figure 13:
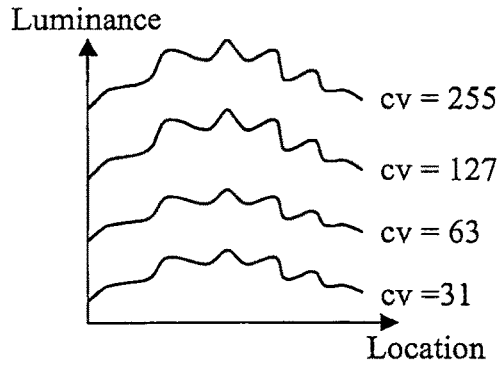
FIG. 13 illustrates original luminance without correction.
Figure 14:
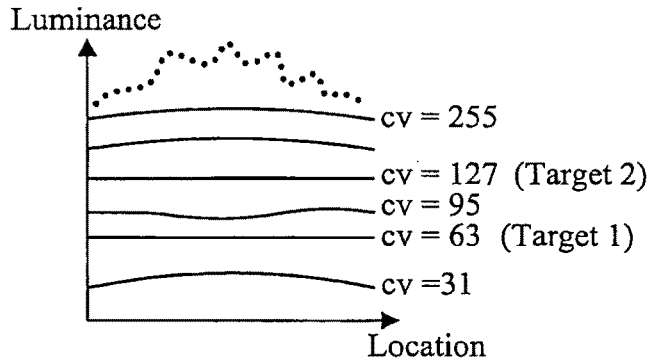
FIG. 14 illustrates multiple image mura correction.

In some cases, to provide more accurate mura correction while maintaining the dynamic range and limiting the storage requirements, a multiple mura correction technique may be used. Compared with brute-force correction, multiple image correction corrects the mura based upon several gray levels (e.g. cv=63 and 127), as illustrated in FIGS. 13 and 14.

Figure 15:
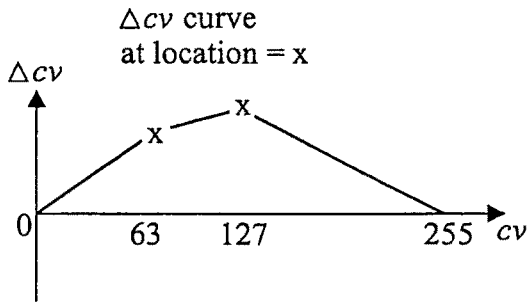
FIG. 15 illustrates a delta curve for multiple image mura correction.

Referring to FIG. 15, in multiple image correction, the correction code value ($\Delta cv$) of other non-target gray levels are determined by interpolation assuming $\Delta cv=0$ at gray level 0 (lower limitation) and 255 (upper limitation) because mura of intermediate gray level is more visible. Once the Acv of the target gray levels are determined by using one of the proposed techniques, such as brute-force, single image, multiple image, and HVS-based correction, input images to display can be corrected by reference of LUT and interpolation as illustrated in FIG. 16.

Figure 16:
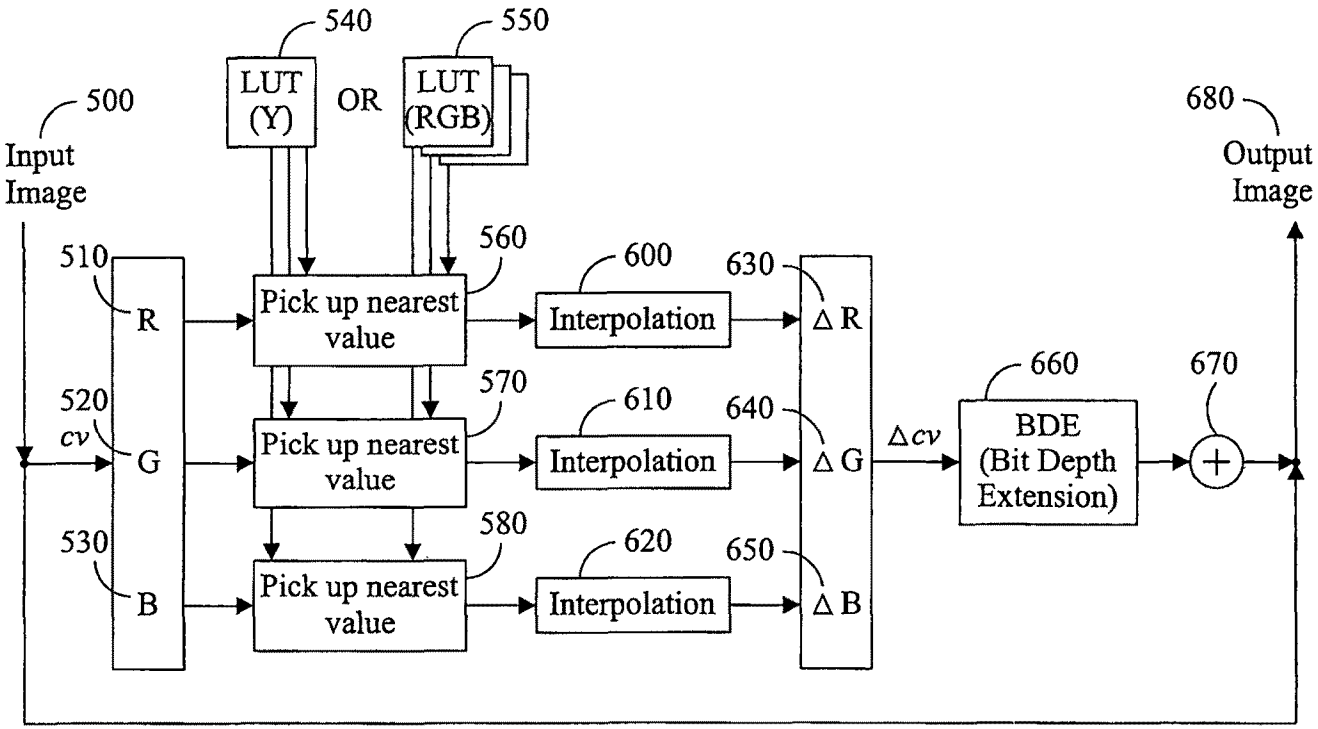
FIG. 16 illustrates a block diagram for mura correction.

Referring to FIG. 16, the mura correction system is flexible for implementation because the image processing does not depend on characteristics of each panel. Also, the system has the capability to adapt to other mura correction techniques. The input image 500 may be separated by color planes into R 510, G 520, and B 530. A luminance look up table 540 or a color dependant look up table 550 may be used to select near code values 560, 570, 580 within the respective look up table for the respective pixel. The selected code values are interpolated 600, 610, 620, to determine an interpolated code value. The interpolated code values 600, 610, 620 are then used for determining 630, 640, 650 the adjustment for the respective pixel. It is to be understood that other suitable color spaces may likewise be used, such as for example, YUV, HSV. A bit depth extension process 660 may be used, if desired. The output of the bit depth extension process 660 is added 670 to the input image 500 to provide a mura corrected output image 680.

Color mura correction aims to correct non uniformity of color by using color based LUT. The same correction techniques (e.g. brute-force, HVS based, single image, multiple image) are applicable to using color mura LUT. The primary difference between luminance mura correction and color mura correction is to use colored gray scale (e.g. (R, G, B)=(t, 0, 0), (0, t, 0), (0, 0, t)) for capturing images. If the display is RGB display, the data size is 3 times larger than the luminance correction data. By correcting each color factor separately can achieve not only luminance mura correction but also color mura correction.

Backlight modulation provides the ability to increase the dynamic range of an LCD. In combination with reducing the backlight, the image data sent to the LCD is brightened in a process referred to as brightness preservation. Brightness preservation uses a model of the display output at different backlight levels to determine the modification necessary to reproduce the same output at a different backlight level. Brightness preservation may be useful to incorporate together with mura reduction, to reduce power consumption. Both the lower black and higher white regions of the tone scale should be mapped into the mura correction range, as appropriate. Traditionally, brightness preservation seeks the lowest black level and hence maps zero to zero in the boosting process of the liquid crystal material. When brightness preservation is combined with mura correction, when a low black level is selected, the brightness preservation should increase the code values so that the dark region is in the mura correction range. Similarly in traditional applications the brightness preservation module is always brightening the image. When brightness preservation is combined with mura correction, when a bright level is selected, the backlight should be selected greater than the nominal full backlight and the brightness preservation module will darken the image mapping 255 to a lower value in the Mura correction range. A brief review of the general concepts of traditional brightness preservation is presented and its modification to support mura compensation.

The light source of liquid crystal displays are usually either a series of fluorescent tubes or a light emitting diode array. Once the display is larger than a typical size of 18", the majority of the power consumption is due to the light source. For certain applications, and in certain markets, potential reduction of power is important. However, unfortunately a reduction in power means a reduction in the light flux of the backlight, and thus a reduction of the maximum brightness of the display.

An equation relating current gamma-corrected LCD's gray level code values, CV, backlight light source level, $L_{source}$, and output light level, $L_{out}$, is:

$$L_{out}=L_{source}*g(CV+\text{dark})^{\gamma}+\text{ambient} \quad (1)$$

Where g is a calibration gain, dark is the LCD dark level, and ambient is the light hitting the display from the room conditions. From this equation, it can be seen that reducing the backlight light source by x % also reduces the light output by x %. The reduction in the backlight light level can be compensated by changing the LCD values; in particular boosting them (increasing the transmittance). In fact, any light level less than (1−x %) can be reproduced exactly, while any light level above (1−x %) cannot be reproduced exactly, because there is no capability going brighter than the backlight output.

The basic code value correction for code values for an x % reduction is (assuming dark and ambient are 0):

$$L_{out}=L_{source}*g(CV)^{\gamma}=L_{reduced}*g(CV_{boost})^{\gamma} \quad (2)$$

$$CV_{boost}=CV*(L_{source}/L_{reduced})^{1/\square}=(1/x\%)^{1/\gamma}. \quad (3)$$

Figure 17A:
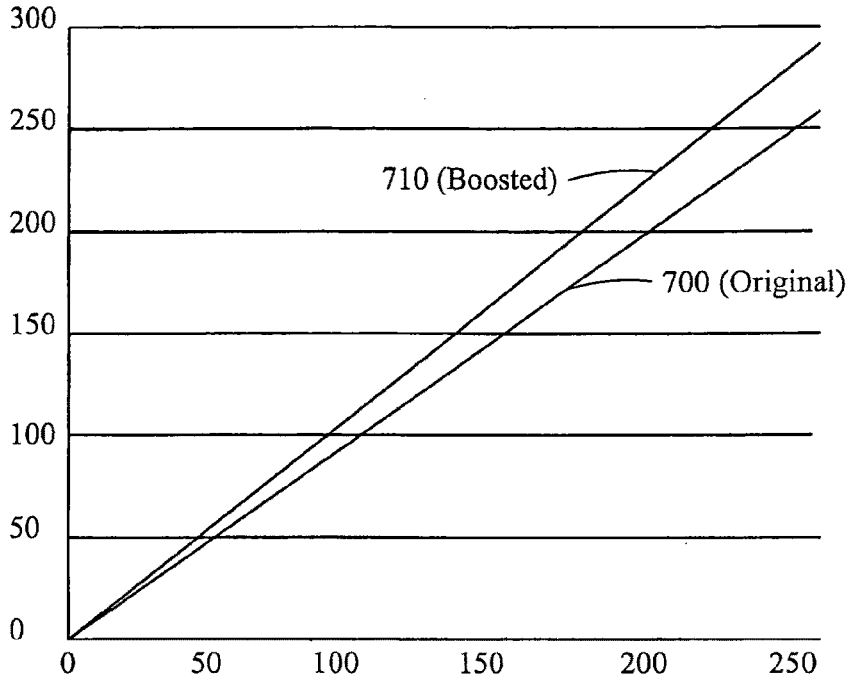
FIGS. 17A and 17B illustrate compensating brightness loss.
Figure 17B:
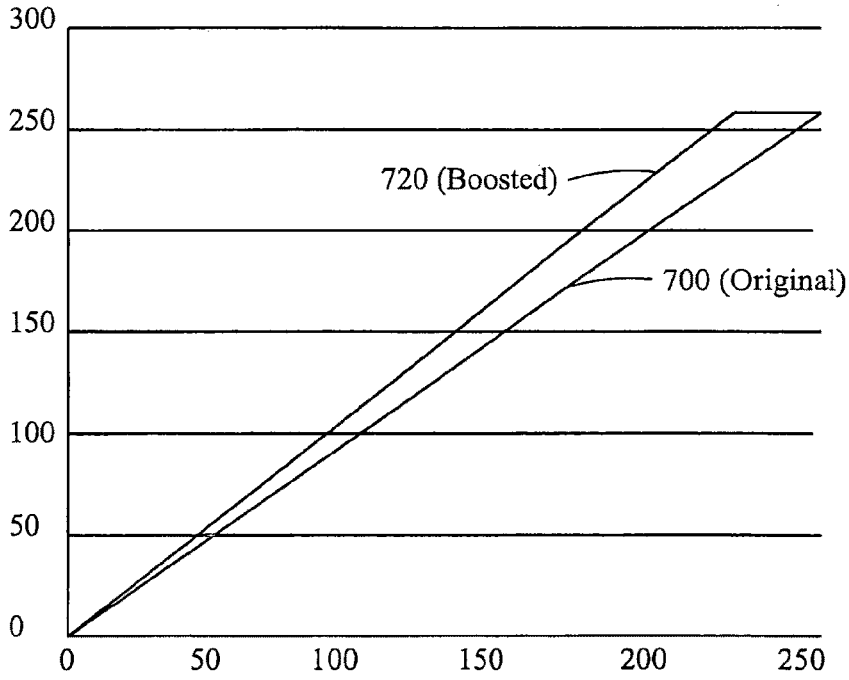

FIG. 17A shows such a boost from line 700 to line 710. However, line 710 results in code values higher than the LCD is capable of producing (e.g., 255 for an 8 bit display). Referring to FIG. 17B, line 720 ends up being clipped at a maximum of 255. Images corrected this way result in washed out highlights, often looking artificial, and in general, low quality.

For code values below the clipping value of 230 (value 230 is boosted to 255) in FIG. 17, the luminance of the original display with this code value equals the luminance of the display with power reduction with the boosted code value. The same luminance is produced with a lower power resulting in power savings. If the set of code values of an image are confined to the range below the clipping point the power savings mode can be operated transparently to the user. Unfortunately, when values exceed the clipping point, the anticipated luminance is reduced and details are lost at the high end. The brightness preservation technique should alter the LCD code values while simultaneously keeping the advantage of using the code value boost to match the display luminance, while reducing the clipping artifacts.

Figure 18:
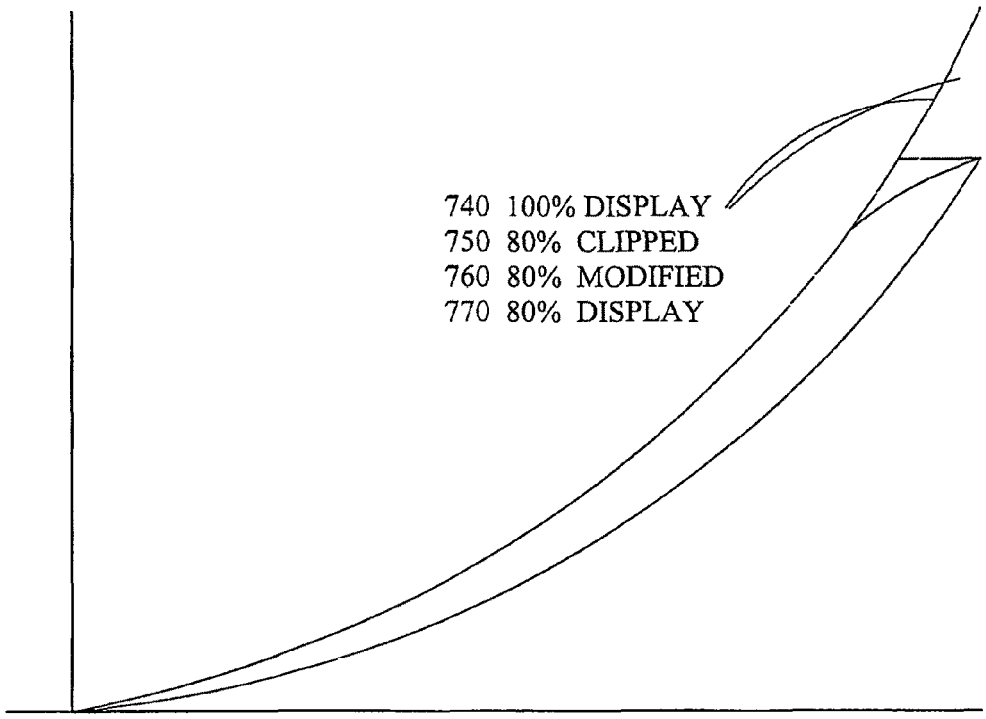
FIG. 18 illustrates actual luminances.

The first step is to consider actual luminances that are displayed, in FIG. 18. The 100% power backlight tonecurve 740 (luminance vs. gray level) is shown as the top curve. Simply reducing the backlight light level 770 (to 80%) gives the bottom curve. Boosting the LCD code values to compensate and allowing for clipping results in the second highest curve 750. A modified technique to boost, yet avoid the sharp clipping region, resulting in a curve like the second from the bottom 760.

In this example, a maximum fidelity point (MFP) of 180 was used. Note that below code value 180, the modified technique matches the luminance output by the original 100% power display. Above 180, the proposed method smoothly transitions to the maximum output allowed on the 80% display. The smoothness reduces clipping and quantization artifacts. One manner of achieving this is to define the tone scale function piecewise matching smoothly at the transition point given by the MFP. Below the MFP, the boosted tone scale function is used. Above the MFP, a curve is fit smoothly to the end point of the curve at the MFP and fit to the end point [255,255].

$$ToneScale_{boost}(cv) = (1/x)^{1/\gamma} \cdot cv$$

$$ToneScale_{clipped}(cv) = \begin{cases} (1/x)^{1/\gamma} \cdot cv & cv \le 255 \cdot (x)^{1/\gamma} \\ 255 & \text{otherwise} \end{cases}$$

$$ToneScale_{Proposed}(cv) = \begin{cases} (1/x)^{1/\gamma} \cdot cv & cv \le MFP \\ A \cdot cv^2 + B \cdot cv + C & \text{otherwise} \end{cases}$$

Figure 19:
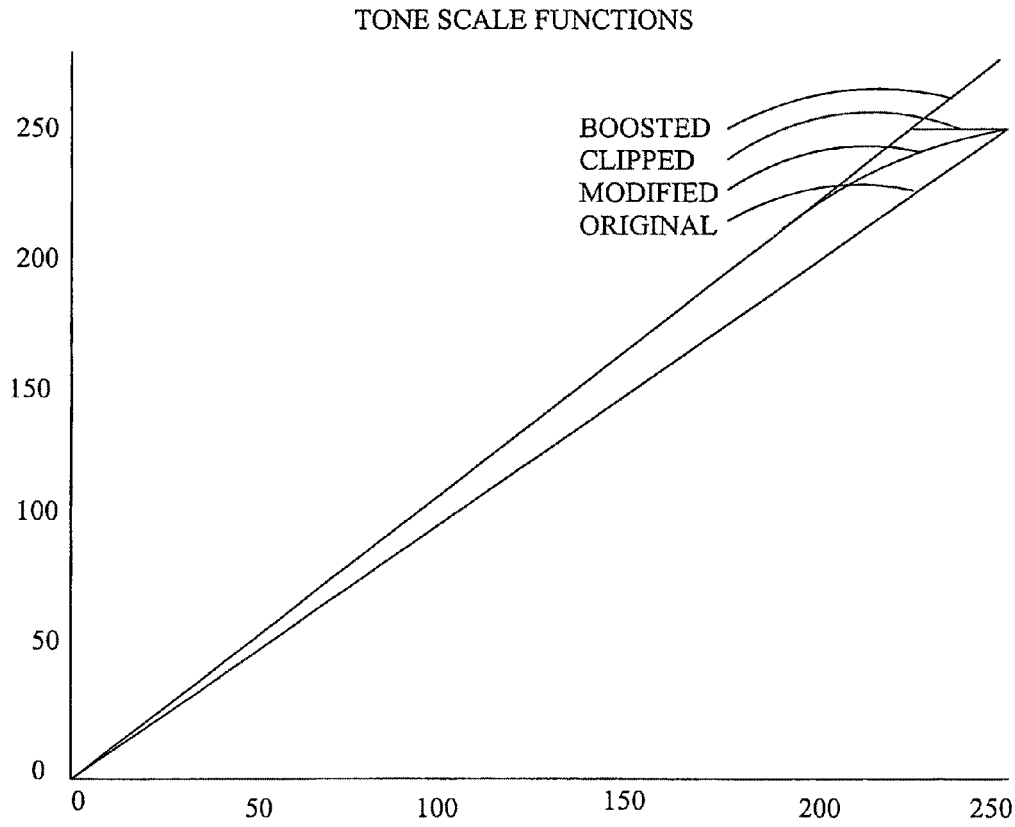
FIG. 19 illustrates tone scale functions.

The constants A, B, and C are chosen to give a smooth fit at MFP and so that the curve passes through the point [255,255]. Plots of these functions are given below in FIG. 19.

One of the concepts of brightness preservation is that luminance values that can be represented by the display when operating at lower power should be represented "exactly". Achieving this may be performed through a boost of the tone scale. Unfortunately, direct use of this results in clipping artifacts. Preferably, the tone scale function is rolled off smoothly controlled by the MFP parameter. Large values of MFP give luminance matches over a wide interval but increase the visible quantization/clipping at the high end of code values.

In a simple gamma display model the scaling of code values gives a scaling of luminance values, with a different scale factor. Scaling the backlight power corresponds to the linear reduced equations where a percentage p is applied to the output of the display, not the ambient. This multiplicative factor can be pulled into the power function if suitable modified. This modified factor scales both the code values and the offset. Scaling only the code values by the modified factor allows simulation of the backlight power reduction on a display with full backlight power.

Line luminance reduction equations:

$$L_{Linear\ reduced}=p\cdot G\cdot(CV+\text{dark})^{\gamma}+\text{ambient}$$

$$L_{Linear\ reduced}=G\cdot(p^{1/\gamma}\cdot(CV+\text{dark}))^{\gamma}+\text{ambient}$$

$$L_{Linear\ reduced}=G\cdot(p^{1/\gamma}CV+p^{1/\gamma}\cdot\text{dark})^{\gamma}+\text{ambient}$$

Figure 20:
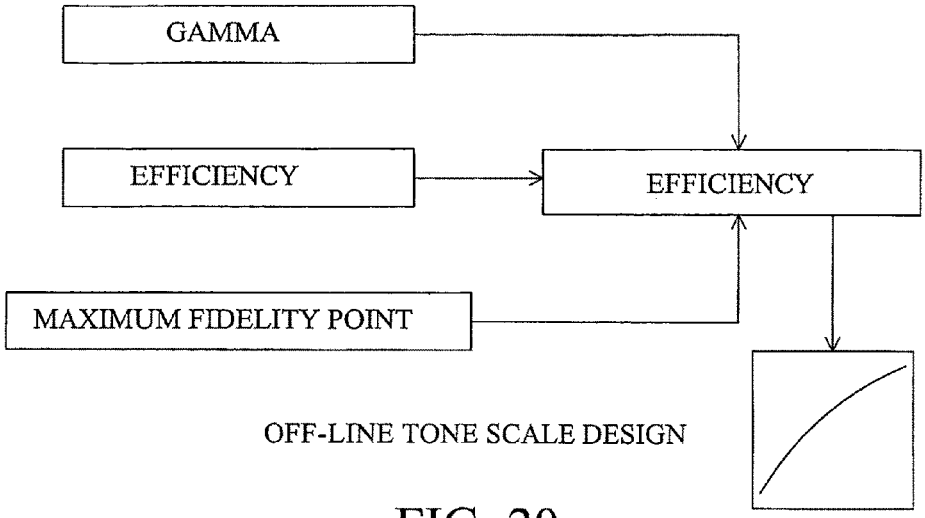
FIG. 20 illustrates off-line tone scale design.
Figure 21:
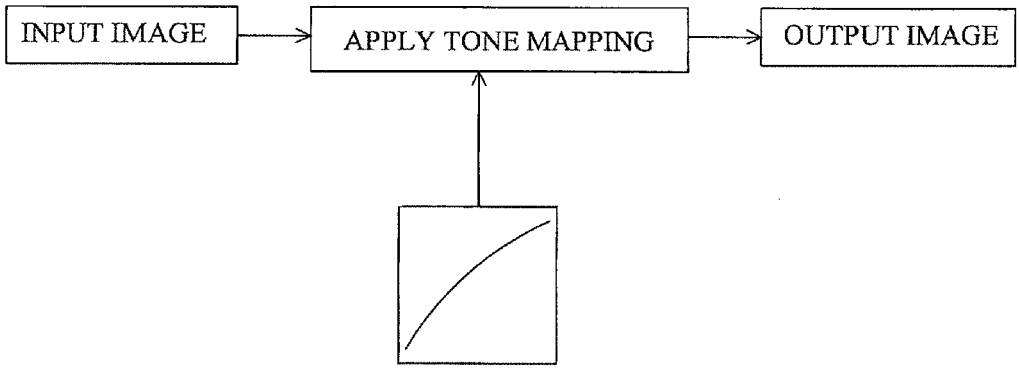
FIG. 21 illustrates on-line tone scale mapping.

A block diagram is shown in FIGS. 20 and 21 for implementing tone scale. There are two stages of processing, tone scale function design (FIG. 20) and tone scale application (FIG. 21). The tone scale may be done on-line or off-line. The tone scale design of FIG. 20 may use a display gamma, an efficiency, and a maximum fidelity point (MFP) to construct a tone scale function represented as a curve. The on-line processing of FIG. 21 applies the tone scale function to the input image to produce the output image provided to the display.

For brightness preservation to operate with mura correction, the brightness preservation process may be modified to map into the range of mura correction [L, H] rather than the entire range [0,255] so that the boosted image may be effectively mura corrected. The brightness preservation tonescale may be modified at the bottom and/or top, and preferably both. The modification at the top may be described with the roll-off limit being the value H rather than the maximum 255. The constants in the brightness preservation technique, as described above, may use a linear tonescale near the origin. A consequence of this is zero will go to zero. This gives the lowest black level but does not facilitate improvement in mura correction at zero input. One improvement is to modify the design of the compensation curve so that the boosted image lies within the range of effective mura correction. Initially, it may be assumed that mura correction is effective above code value L. It may also be assumed that display gamma and reduced backlight are given. With this information, a modified compensation curve may be selected. The curve may be the same above for middle to large code value differing primarily at the dark end.

The defining relation is:

$$B\cdot(y^{\gamma}=L^{\gamma})=x^{\gamma}$$

Where x is the image value, gamma is the display gamma parameter, B is the relative backlight, L is the lower limit on the mura correction ability, and y>L is the output of the brightness preservation process. Note that for large x the L term is minimally relevant.

The brightness preservation cure is preferably limited to the mura correction range and that it corrects brightness in the middle section of code values. An exemplary equation depending upon gamma, backlight (BL), maximum fidelity point y (MFPY), and limits on the Mura correction range [MinimumMuraCorrection, MaximumMuraCorrection] is:

$$\text{Slope}=\left(\frac{1}{BL}\right)^{\frac{1}{\gamma}}$$

$$MFPX=\frac{MFPY}{\text{Slope}}$$

$$XClip=\frac{CodeValueMax}{\text{Slope}}$$

$$XRollOffClip=\min(CodeValueMax,\ 2*XClip-MFPX)$$

-continued $$A=\frac{MaximumMuraCorrection-MFPY-\text{Slope}\cdot(XRollOffClip-MFPX)}{(XRollOffClip-MFPX)^2}$$

$$BPToneScale(x)=\begin{cases}CodeValueMax\cdot\left(\frac{1}{BL}\cdot\left(\frac{x}{CodeValueMax}\right)^{\gamma}+\left(\frac{MinimumMuraCorrection}{CodeValueMax}\right)^{\gamma}\right)^{\frac{1}{\gamma}} & x\le MFPX\\ MFPY+\text{Slope}\cdot(x-MFPX)+A\cdot(x-MFPX)^2 & MFPX<x\end{cases}$$

Figure 22:
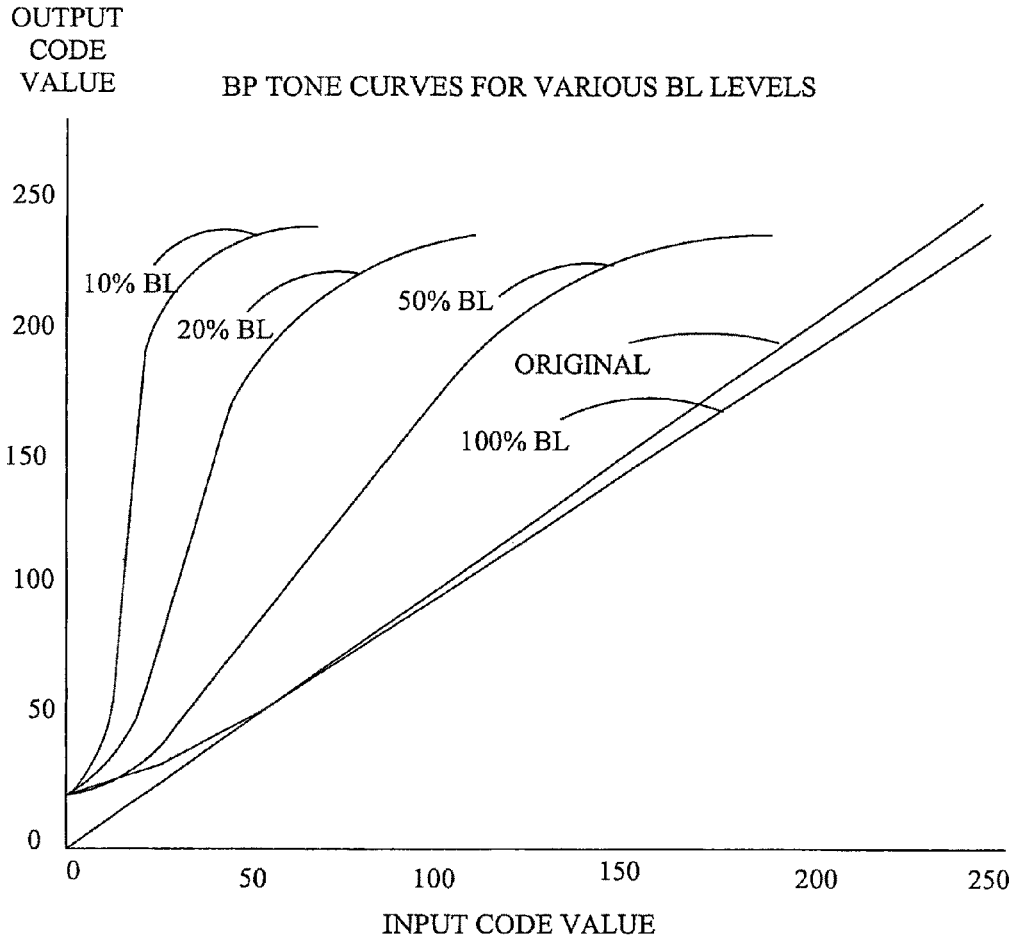
FIG. 22 illustrates plot of tone curves for various levels.

Using this equation, illustrations of correction curves and their effect on a display for a range of backlights fixing the other parameters as follows: gamma=2.2, mura correction range=[20,247], and MFPY=180 is shown in FIG. 22. Note that the brightness preservation operation maps the original image into the range of mura correction. Each brightness preservation map is designed to compensate for backlight variation in the middle of the tonescale. The display output corresponding to different backlight levels and tone curves is also illustrated assuming the display has contrast ratio 2000:1 and maximum luminance of 450 Cd/m2. The plots show the compensating curve for different relative backlight levels. It is noted that the curve corresponding to backlight over 100% as this is used with a backlight selection greater than 100% as noted in the modification to the backlight selection.

Figure 23:
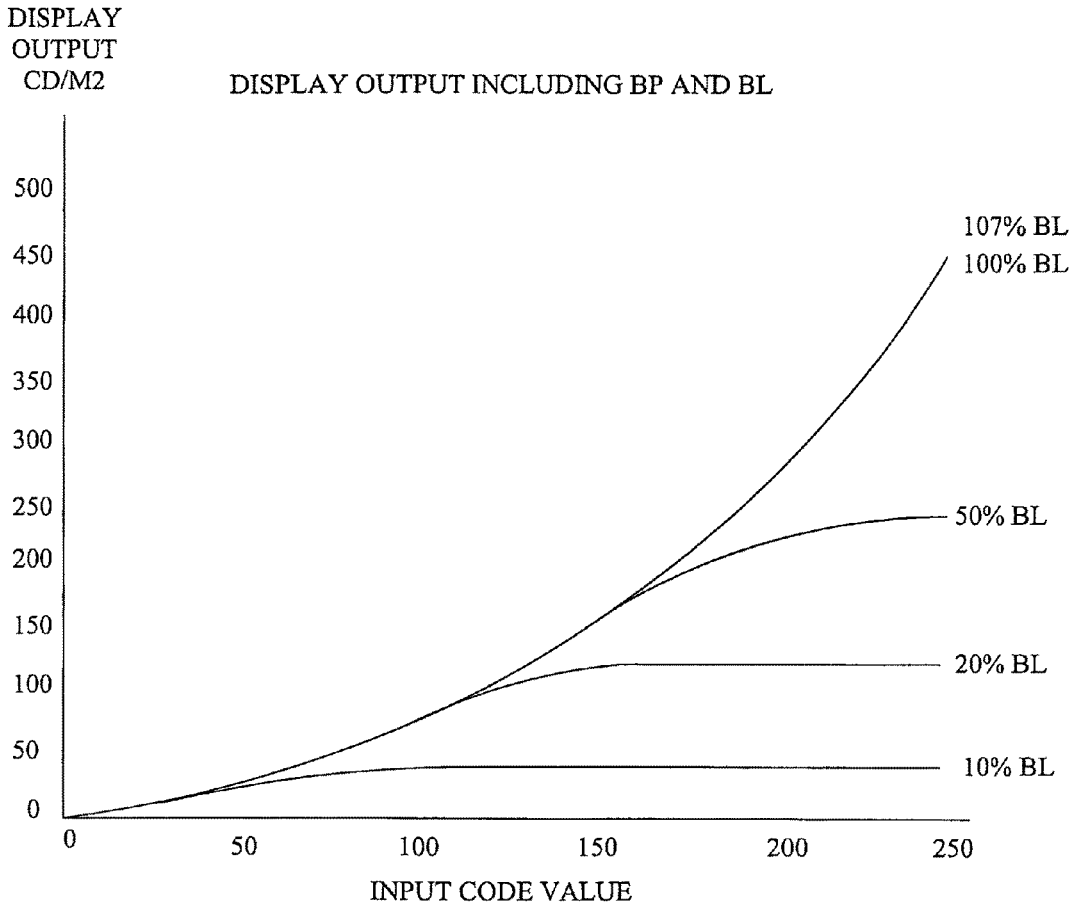
FIG. 23 illustrates display output including BP and BL.
Figure 24:
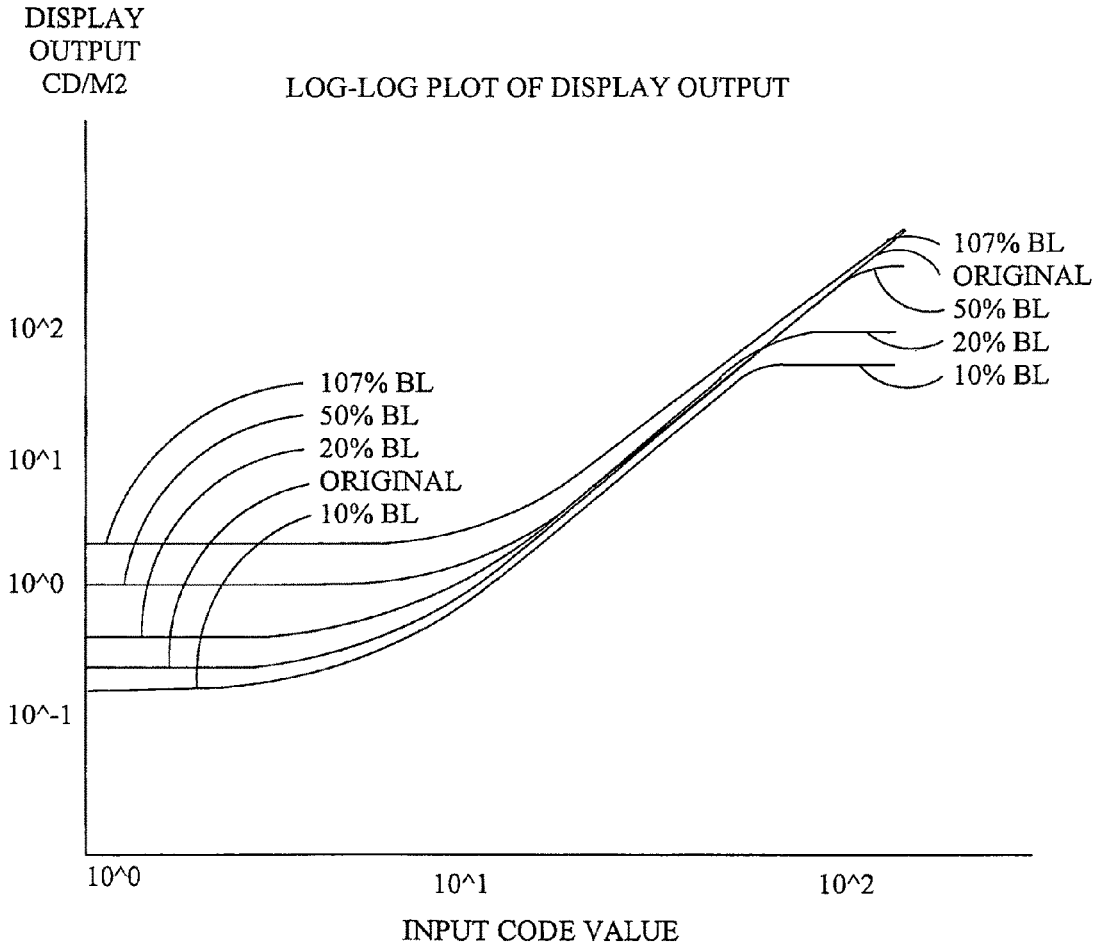
FIG. 24 illustrates a log-log plot of display output.

The display output corresponding to the backlight change and compensating tone curves are shown in FIGS. 23 and 24. The backlight value of 107% is used to achieve the original display output while mapping the image into the mura correction range. The elevation of the black level due to the lower limit of the mura correction range is observed in FIG. 24. Backlight reduction can reduce the black level so that with 20% backlight, the black level including BP equals that of the original display.

Selection of the backlight level is a part of the backlight modulation system. For power saving applications, the backlight is typically selected as low as possible but high enough to still be able to represent the brightest element of an image. For a LCD with finite contrast ratio, the black level can be reduced by lowering the backlight. Thus two conflicting goals: high backlight to represent image brightness and low backlight to reduce black level are balanced based on image content to select the backlight. A distortion function which measures the error due to values being outside of the range representable by a display is used. In the mura correction application, the distortion function can be modified to account for the fact that an image value to be displayed lies outside of the mura correction range. For example, the backlight may be chosen so that the boosted image lies within the correctable range. A summary of distortion based backlight selection is provided, by way of information, followed by modifications to incorporate error due to lack of mura correction.

The known GoG display model is used for both the hypothetical reference display and the actual LCD. This model is modified to scale based on the backlight level. The hypothetical reference display is modeled as an ideal display with zero black level and maximum output W. The actual display is modeled as having the same maximum output W at full backlight and a black level of B at full backlight. The contrast ratio is W/B. The contrast ratio is infinite when the black level is zero. These models can be expressed mathematically using a $CV_{Max}$ to denote the maximum image code value in the equations below.

The Model Of Hypothetical Reference (Ideal) Display output may be as follows:

$$Y_{Ideal}(cv) = W \cdot \left(\frac{cv}{cv_{Max}}\right)^{\gamma}$$

An actual LCD has maximum output W and minimum output B at full backlight level i.e. P=1. The output is modeled as scaling with relative backlight level P. The contrast ratio CR=W/B is independent of backlight level.

The Model Of Actual LCD may be as follows:

$$Y_{Actual}(P, cv) = P \cdot \left(\text{Gain} \cdot \frac{cv}{cv_{Max}} + \text{Offset}\right)^{\gamma}$$

$$\text{Offset} = B^{\frac{1}{\gamma}}$$

$$\text{Gain} = W^{\frac{1}{\gamma}} - B^{\frac{1}{\gamma}}$$

$$B(P) = P \cdot B$$

$$W(P) = P \cdot W$$

$$CR = W / B$$

For an example, the brightness preservation process may be based on a boost and clip chosen to compensate for the backlight reduction where possible. The following derivation shows the tone scale modification which provides a luminance match between the reference display and the actual display at a given backlight. Both the maximum output and black level of the actual display scale with backlight. It is noted that the output of the actual display is limited to below the scaled output maximum and above the scaled black level. This corresponds to clipping the luminance matching tone scale output to 0 and $CV_{max}$. The criteria for matching outputs may be characterized as:

$$Y_{ideal}(cv) = Y_{actual}(P, cv')$$

$$W \cdot \left(\frac{cv}{cv_{Max}}\right)^{\gamma} = P \cdot \left(\left(W^{\frac{1}{\gamma}} - B^{\frac{1}{\gamma}}\right) \cdot \left(\frac{cv'}{cv\text{Max}}\right) + B^{\frac{1}{\gamma}}\right)^{\gamma}$$

$$cv' = \frac{cv\text{Max}}{\left(W^{\frac{1}{\gamma}} - B^{\frac{1}{\gamma}}\right)} \cdot \left(\left(\frac{W}{P} \cdot \left(\frac{cv}{cv_{Max}}\right)^{\gamma}\right)^{\frac{1}{\gamma}} - B^{\frac{1}{\gamma}}\right)$$

$$cv' = \frac{1}{P^{\frac{1}{\gamma}} \cdot \left(1 - \left(\frac{B}{W}\right)^{\frac{1}{\gamma}}\right)} \cdot cv - \left(\frac{B}{W}\right)^{\frac{1}{\gamma}} \cdot \frac{cv\text{Max}}{\left(1 - \left(\frac{B}{W}\right)^{\frac{1}{\gamma}}\right)}$$

The clipping limits on cv' imply clipping limits on the range of luminance matching may be characterized as:

$$cv' \geq 0$$

$$\Rightarrow$$

$$\frac{1}{P^{\frac{1}{\gamma}} \cdot \left(1 - \left(\frac{B}{W}\right)^{\frac{1}{\gamma}}\right)} \cdot \cdot cv \geq \left(\frac{B}{W}\right)^{\frac{1}{\gamma}} \cdot \frac{cv\text{Max}}{\left(1 - \left(\frac{B}{W}\right)^{\frac{1}{\gamma}}\right)}$$

-continued $$cv \geq cv\text{Max} \cdot \left(\frac{B}{W}\right)^{\frac{1}{\gamma}} \cdot P^{\frac{1}{\gamma}}$$

$$cv' \leq cv\text{Max}$$

$$\Rightarrow$$

$$\frac{1}{P^{\frac{1}{\gamma}} \cdot \left(1 - \left(\frac{B}{W}\right)^{\frac{1}{\gamma}}\right)} \cdot cv - \left(\frac{B}{W}\right)^{\frac{1}{\gamma}} \cdot \frac{cv\text{Max}}{\left(1 - \left(\frac{B}{W}\right)^{\frac{1}{\gamma}}\right)} \leq cv\text{Max}$$

$$cv \leq cv\text{Max} \cdot P^{\frac{1}{\gamma}}$$

The clipping points may be characterized as:

$$x_{low}(P) = cv\text{Max} \cdot \left(\frac{P}{CR}\right)^{\frac{1}{\gamma}}$$

$$x_{high}(P) = cv\text{Max} \cdot (P)^{\frac{1}{\gamma}}$$

The tone scale provides a match of output for code values above a minimum and below a maximum where the minimum and maximum depend upon the relative backlight power P and the actual display contrast ratio CR=W/B.

Figure 25:
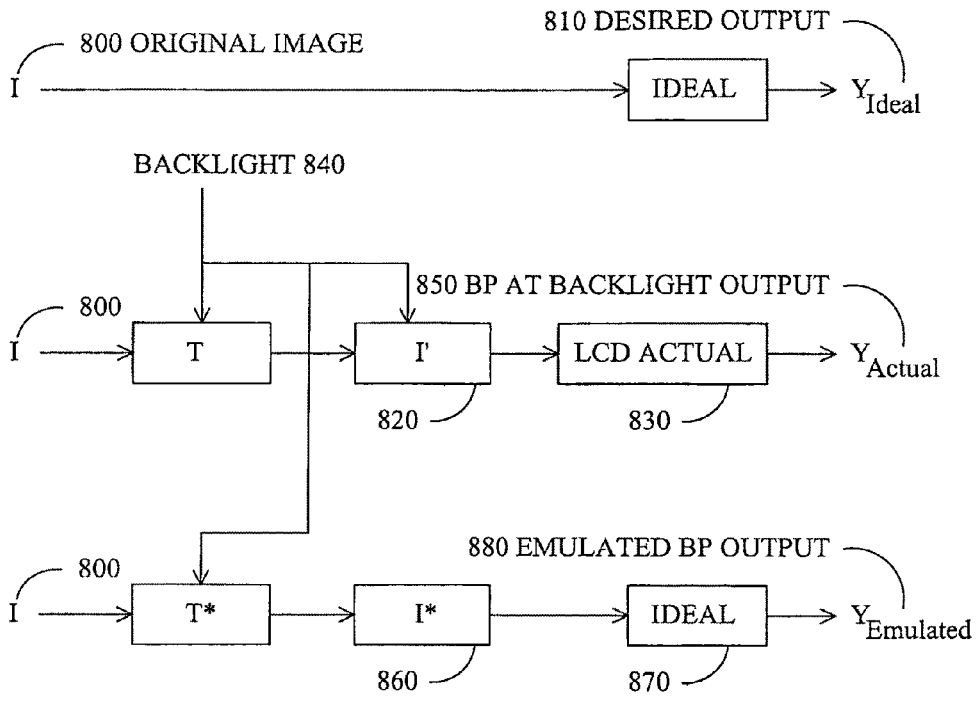
FIG. 25 illustrates related images and displays.

To describe the distortion calculations one may first illustrate the relevant images. Related images and displays used in the following discussion are shown in FIG. 25. An original image I 800 is shown giving output $Y_{Ideal}$ 810 on the (Ideal) Reference display. Assuming a backlight level is given it is desirable to compute the distortion caused by representing the image with this backlight level on the actual LCD. Brightness preservation is shown generating the image I' 820 from the image I 800. The image I' 820 is then sent to the actual LCD 830 along with the selected backlight level 840. The resulting output is labeled Yactual 850. The reference display is able to emulate the output of the actual display by using an input image I* 860. The output Yemulated 880 of the reference (Ideal) display 870, is based upon the output of the actual display and the output of the reference display when emulating the actual display output.

The output of the actual LCD is the result of passing the original image I through the luminance matching tone scale function to get the image I'. This does not exactly reproduce the reference output depending upon the backlight level. It may be observed however that the actual display output can be emulated on the reference display. The image I* denotes the image data sent to the reference display to emulate the actual display output. The image I* is given by clipping the image I to the range determined by the clipping points.

$$I^*(cv, P) = \begin{cases} x_{low}(P) & cv \leq x_{low}(P) \\ cv & x_{low}(P) < cv < x_{high}(P) \\ x_{high}(P) & x_{high}(P) \leq cv \end{cases}$$

The distortion may be defined as the difference between the output of the reference display with image I and the output of the actual display with backlight level P and image I'. Since image I* emulates the output of the actual display on the reference display, the distortion between the reference and actual display equals the distortion between the images I and I* both on the reference display.

$$D(Y_{Ideal}, Y_{Actual}) = D(Y_{Ideal}, Y_{Emulated})$$

Since both images are on the reference display, the distortion can be measured between the image data only not needing the display output.

$$D(Y_{Ideal}, Y_{Emulated}) = D(I, I^*)$$

The analysis above shows the distortion between the representation of the image I on the reference display and the representation on the actual display is equivalent to the distortion between that of images I and I* both on the reference display. One may use a point wise distortion metric to define the distortion between images. Given the point wise distortion d the distortion between images can be computed by summing the difference between the images I and I*. Since the image I* emulated the luminance match, the error consists of clipping at upper and lower limits. The normalized image histogram h(x) may be used to define the distortion of an image versus backlight power as follows:

$$D(I, I^*) = \sum_x d(x, T^*(x, P))$$

$$D(I, P) = \sum_{x < cv_{low}(P)} \tilde{h}(x) \cdot d(x - cv_{low}(P)) + \sum_{x > cv_{high}(P)} \tilde{h}(x) \cdot d(x - cv_{high}(P))$$

Given reference display, actual display, distortion definition, and image one may compute the distortion at a range of backlight levels. When combined these form a backlight vs distortion curve. One may illustrate these curves by using an ideal display with zero black level, an actual LCD with 1000:1 contrast ratio, and a Mean Square Error MSE error metric.

Figure 26:
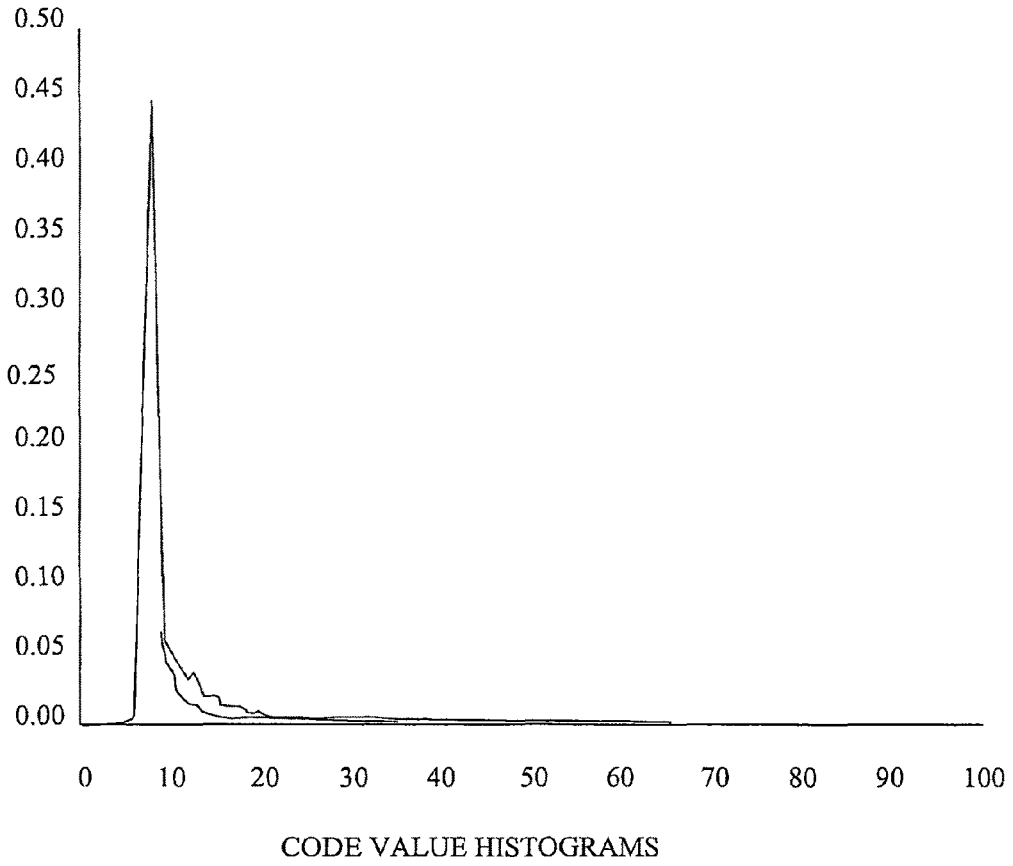
FIG. 26 illustrates code value histograms.
Figure 27:
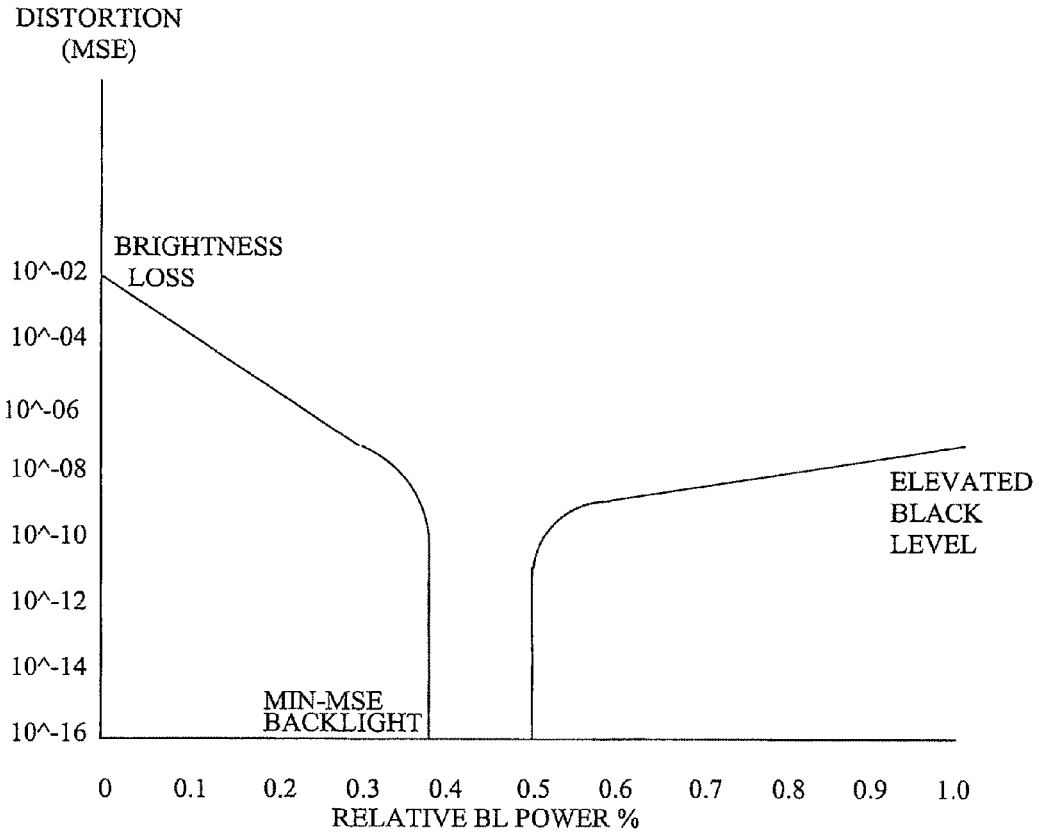
FIG. 27 illustrates minimum distortion backlight determination.

From the histogram illustrated in FIG. 26, the distortion curve illustrated in FIG. 27 may be determined by calculating the distortion for a range of backlight values. Note at low backlight values, the brightness preservation has limited effectiveness for compensating for the reduced backlight resulting in the loss of highlights. At high backlight levels, the limited contrast ratio causes the black level to be elevated compared to the ideal display. A minimum distortion range exists and the lowest backlight value giving this minimum distortion is selected by the minimum distortion algorithm.

Figure 28:
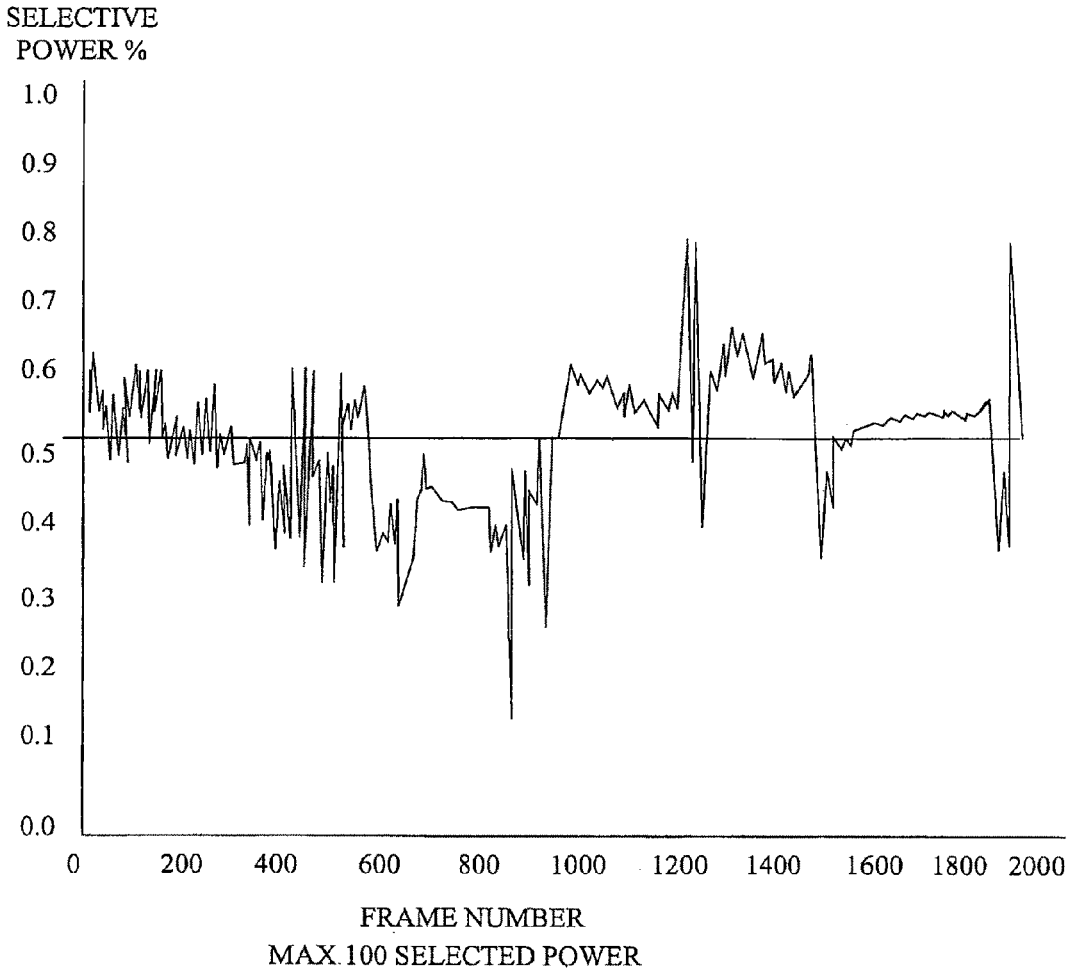
FIG. 28 illustrates power usage.

The distortion curve is used to select the backlight value. In the simplest case, the minimum distortion power for each frame may be selected. In cases where the minimum distortion value is not unique, the least power which gives this minimum distortion may be selected. Results applying this optimization criteria to a video clip are illustrated in FIG. 28 where the average selected backlight is roughly 50%.

Figure 33:
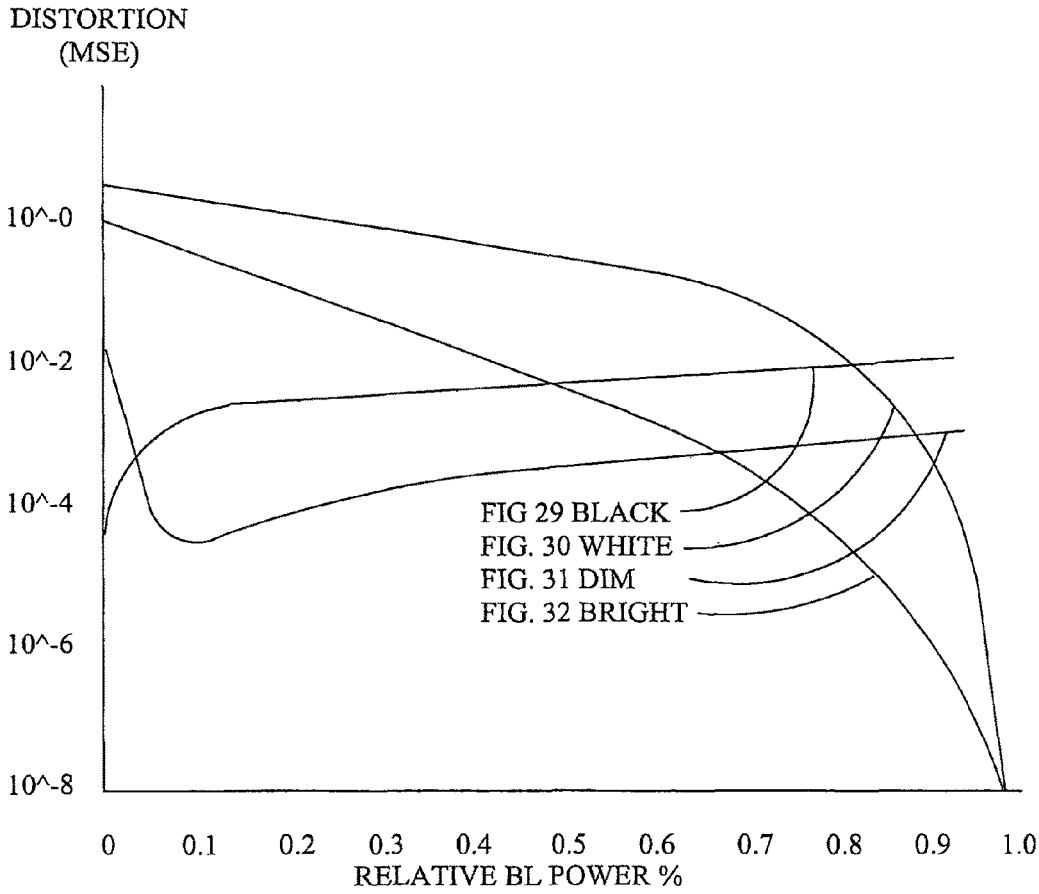
FIG. 33 illustrates backlight power versus distortion.

To illustrate the dependence upon image content, four test images may be used and calculate the distortion for a range of backlight values, illustrates as FIGS. 29-32. A plot of backlight vs distortion curves for FIGS. 29-32 is shown in FIG. 33.

It may be observed that the shape of the curve depends strongly on the image. This occurs because as the backlight level balances distortion due to loss of brightness and distortion due to elevated black level. The black image has least distortion at low backlight. The white image has least distortion at full backlight. The dim image has least distortion at an intermediate backlight level which uses the finite contrast ratio as an efficient balance between elevated black level and reduction of brightness.

Figure 34:
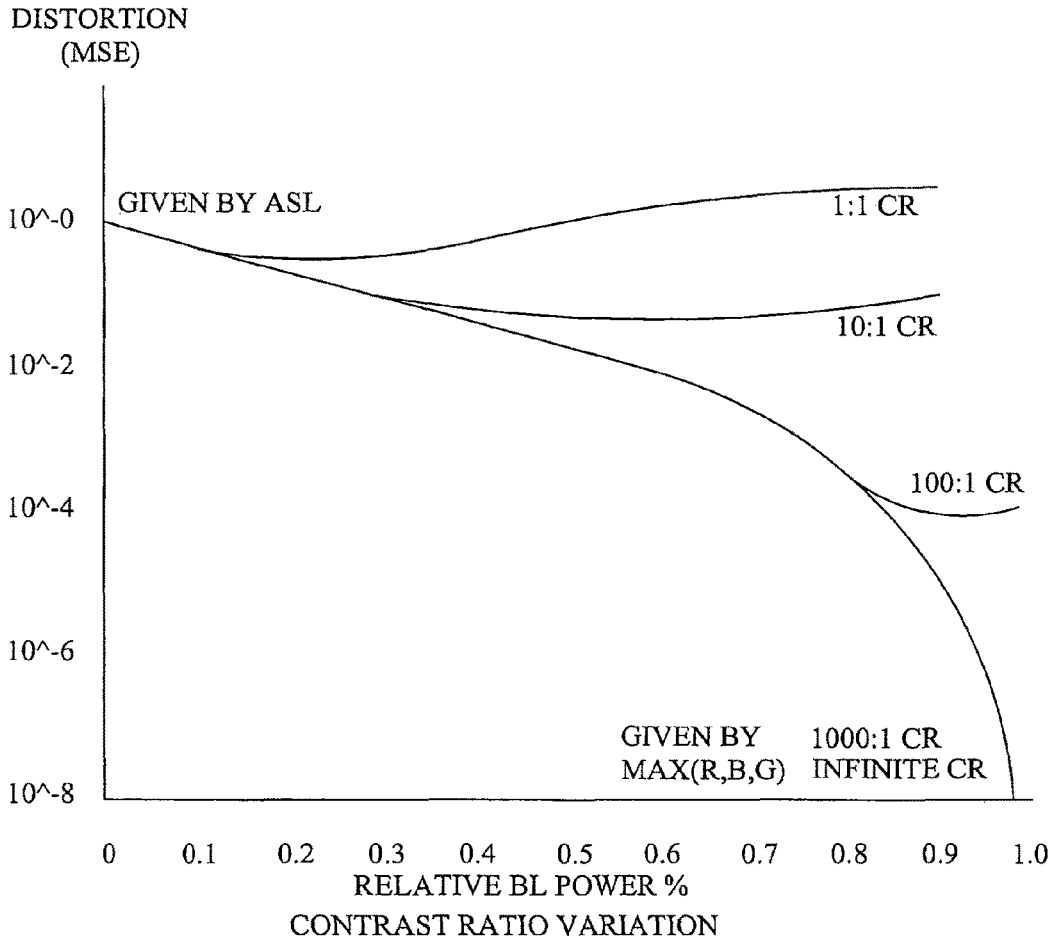
FIG. 34 illustrates contrast ratio variation.

The display contrast ratio enters into the definition of the actual display. Referring to FIG. 34, the minimum MSE distortion backlight determination is illustrated for different contrasts ratios of the actual display. It is noted that at the limit of 1:1 contrast ratio, the minimum distortion backlight depends upon the image Average Signal Level (ASL). At the opposite extreme of infinite contrast ratio, zero black level, the minimum distortion backlight depends upon the image maximum.

The backlight selection technique described is designed to select the minimum backlight level allowing image quality to be preserved by the backlight compensation module. As such the boosted image will typically contain data near the upper limit of the LCD i.e. 255 since otherwise a lower BL value could be used and the LCD data increased without loss of quality. In this case, the image data is in bright range where mura correction is not as effective. To maintain effective mura correction, one may select a larger backlight value. If mura correction is effective below a value M, one may increase the backlight values slightly so that the boosted image will have maximum at most M. This may be determined as follows:

$$B \cdot \left(\frac{255}{255}\right)^{\gamma} = \tilde{B} \cdot \left(\frac{M}{255}\right)^{\gamma}$$

$$\tilde{B} = B \cdot \left(\frac{255}{M}\right)^{\gamma}$$

This describes the increase in backlight for effective mura correction in terms of the display gamma and the maximum code value where mura correction is effective. Note for gamma=2.2 and M=247, the backlight is increased by 7%.

A different modification for the distortion based approach is to add a distortion term to the equation below measuring upon how far the compensated point is from the mura correction limit.

$$D(I, I^*) = \sum_x d(x, T^*(x, P))$$

$$D(I, P) = \sum_{x < cv_{low}(P)} \tilde{h}(x) \cdot d(x - cv_{low}(P)) + \sum_{x > cv_{high}(P)} \tilde{h}(x) \cdot d(x - cv_{high}(P))$$

Figure 35:
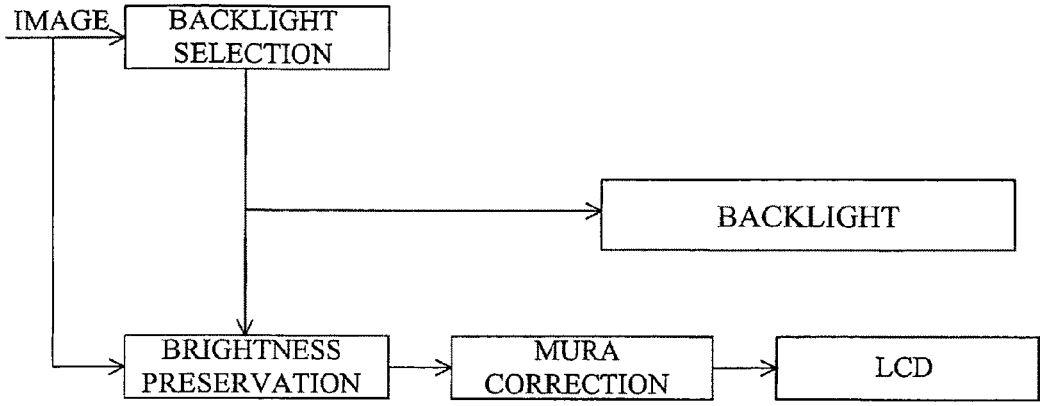
FIG. 35 illustrates a combination of backlight modulation and mura correction.

Referring to FIG. 35, mura correction and backlight modulation can be combined by cascading the mura correction following the brightness preservation module. Using backlight modulation and mura correction will result in improved mura correction in the dark end of frames with low backlight selected since the brightness preservation module will increase values in the dark end of an image moving them into or closer to the range of effective mura correction. This architecture may increase the visibility of mura in bright areas of a frame with low backlight as the boosted image may move values within the mura correction region outside of the mura correction region.

The basic combination can be further modified to give consistent improvement in mura correction. As described above, the backlight is scaled above the value selected by current technique using the following equation:

$$B \cdot \left(\frac{255}{255}\right)^{\gamma} = \tilde{B} \cdot \left(\frac{M}{255}\right)^{\gamma}$$

$$\tilde{B} = B \cdot \left(\frac{255}{M}\right)^{\gamma}$$

Figure 36:
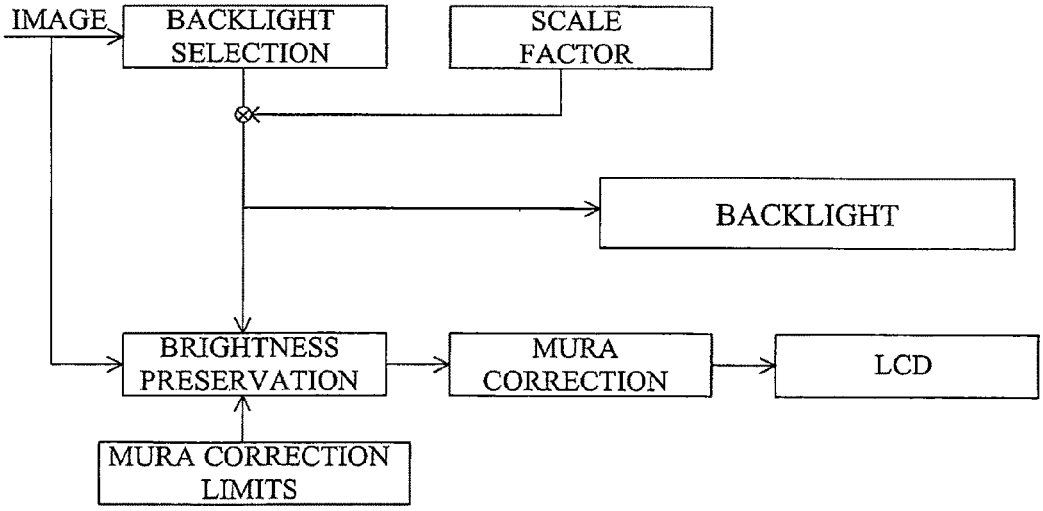
FIG. 36 illustrates mura correction combination.

This preserves mura correction at the bright end of an image. Similarly, the brightness preservation module can be modified to map with an offset so that the dark region of the image is mapped into the effective mura correction range. This combination is shown in FIG. 36. The improved combination gives mura correction for all areas of all images but can suffer some increase in black level in bright images due to the excessive backlight level.

Figure 37:
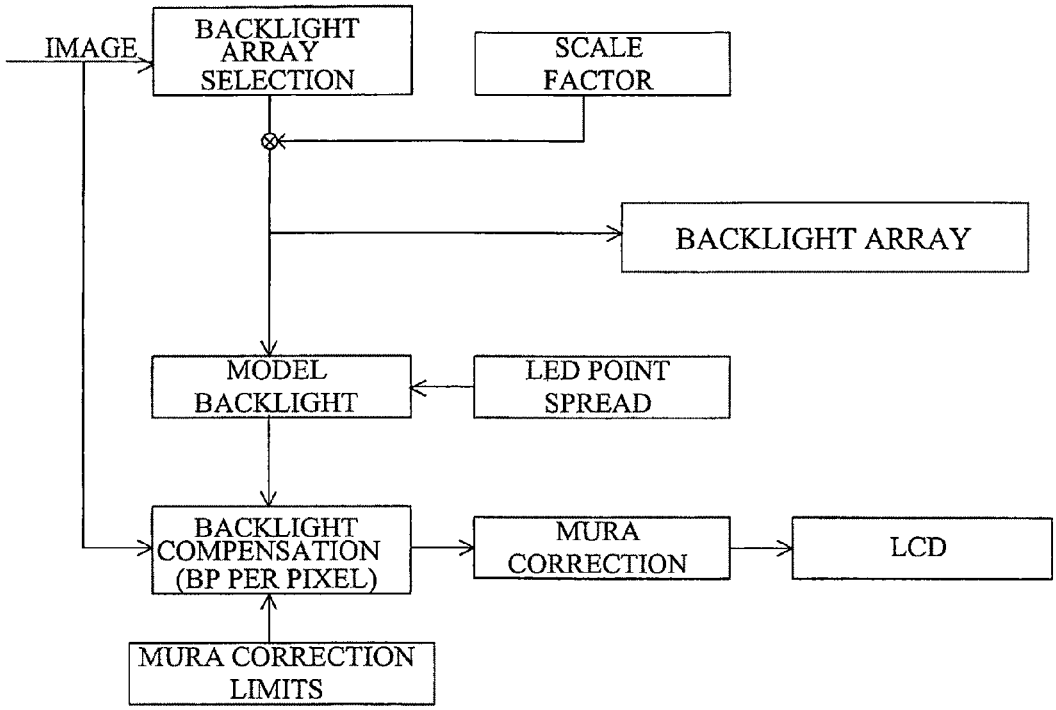
FIG. 37 illustrates active area BL and mura correction.

The prior discussion assumed full-frame backlight modulation (0-D) was used. One limitation of full-frame backlight modulation is that a compromise may be made in selecting the backlight for an image. Dark areas are improved with a low backlight while bright areas need a high backlight. Referring to FIG. 37, the use of an area active backlight avoids this global compromise by using a low backlight in dark areas and a high backlight in bright areas. Since the rendering algorithm for an area active backlight compensates for the variation in backlight signal caused by the spatial variation in the backlight, the mura compensation module can be applied to the spatially boosted image without needing the details of how the image was generated. The refinements described above for improving mura correction of full frame backlight modulation are also used. Namely the backlight signal is boosted above that selected by the existing algorithm to increase effectiveness of mura correction. The result of $$B\cdot\left(\frac{255}{255}\right)^{\gamma}=\tilde{B}\cdot\left(\frac{M}{255}\right)^{\gamma}$$

$$\tilde{B}=B\cdot\left(\frac{255}{M}\right)^{\gamma}$$

describes the scaling in terms of the display gamma and the upper limit of mura correction effectiveness. This applies equally well to the area active backlight signal. The LED driving signal is adjusted accordingly. Secondly, the LCD compensation is modified in the same manner as the full frame backlight compensation to preserve room at the dark end to improve mura correction at the dark end. The backlight compensating image is mapped within the range of effective mura compensation. The difference between the 0-D and 2-D compensation is that the backlight value used at each pixel varies spatially in the 2-D case due to the variation in the backlight.

When analyzing the results of the mura correction on a sufficient number of actual panels from production, it turns out that often the mura correction was sufficient. However, often the mura correction was insufficient for the actual panels from production. Accordingly, the resulting mura effects were often still sufficiently noticeable and thus the display did not have sufficient quality. Analysis of displays with resulting insufficient mura correction revealed that they were those with very severe initial mura or initial high spatial frequency. It is difficult to develop a sufficiently adaptive mura correction that is suitable for displays with minor mura, severe mura, low spatial frequencies, and high spatial frequencies. After consideration of a sufficiently adaptive mura correction it was determined that a mura correction may be applied successively until the display has sufficiently low mura.

Figure 38:
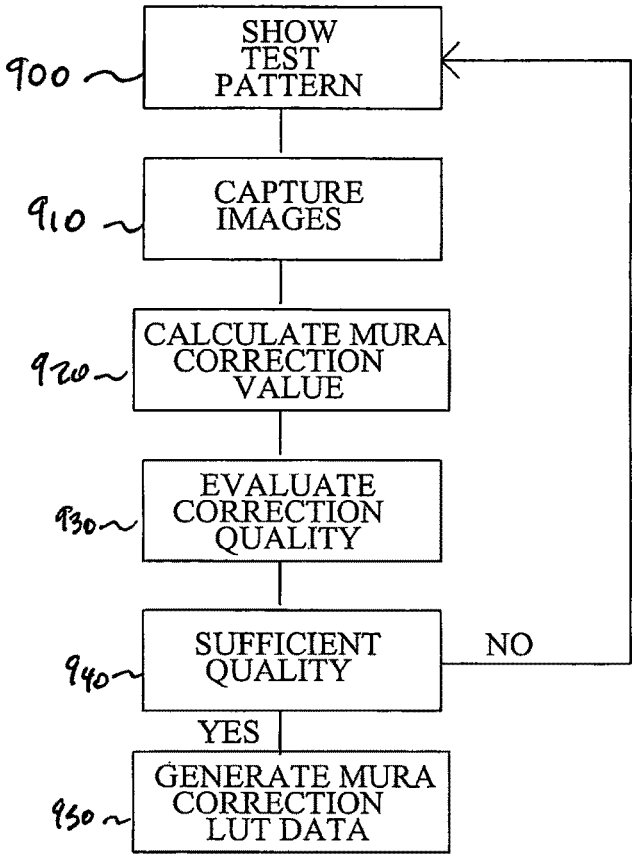
FIG. 38 illustrates multi-pass mura correction.

Referring to FIG. 38, a test pattern is displayed 900. An image is captured 910 of the displayed test pattern. Based upon the captured image 910, a set of mura correction values are calculated 920. The resulting image quality of the display is evaluated 930, based upon the application of the mura correction values, to determine if the resulting mura is sufficiently low. If the display has significant mura 940, then the process is repeated based upon displaying an image with the mura correction data being applied. When the display has sufficiently low mura 940, then a mura correction look up table is generated 950. In this manner, the system may converge on sufficient mura reduction for different levels and types of mura, thus resulting in a display with improved uniformity.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

We claim:

1. A display comprising:

(a) at least one gray level being provided to a plurality of pixels of said display;

(b) said display illuminating each of said pixels with said at least one gray level;

(c) said display applying interpolative mura correction data for said pixels so as to reduce the mura effects of said display where said mura effect is characterized by different grayscale-producing pixel elements of said display having differing luminance-component outputs when said multi-pixel areas are driven by the same luminance value, and adjusting the luminance of a backlight of said display, wherein said mura correction data corrects only for measured mura and is determined based upon an iterative technique.

2. The display of claim 1 wherein the lower tone scale of said display is substantially mapped into said corrective data.

3. The display of claim 1 wherein the higher tone scale of said display is substantially mapped into said corrective data.

4. The display of claim 2 wherein the higher tone scale of said display is substantially mapped into said corrective data.

5. The display of claim 3 wherein a driving value for backlight luminance and a driving value for a transmissive state of a liquid crystal material of said display would clip the maximum luminance of said display if said display was not modified to reduce said mura effects.

6. The display of claim 1 wherein said interpolate corrective data results in said luminance being free from being clipped.

7. The display of claim 1 wherein said adjusting said luminance of said backlight is performed in a manner to substantially eliminate clipping of an image displayed on said display.

8. The display of claim 1 wherein said adjusting said luminance is based upon adjusting the transmittance of a liquid crystal layer together with said adjusting said luminance of said backlight to a range consistent with a range of mura correction for said mura effects.

9. The display of claim 8 wherein said range is less than the maximum luminance of said display.

10. The display of claim 9 wherein said range is greater than the minimum luminance of said display.

11. The display of claim 1 wherein said luminance is adjusted in a manner to substantially minimize the distortion of an image to be displayed on said display.

12. The display of claim 1 wherein different portions of said backlight have different luminance.

13. The display of claim 1 wherein said corrective data is based upon display measurements.

14. The display of claim 1 wherein said corrective data is based upon a weighting function that emphasizes a mid-range over a low range and a high range.

15. The display of claim 1 wherein the dynamic range of said image displayed on said display is greater than it would have otherwise been had the characteristics generally not visible by a human visual system been considered.

16. The display of claim 1 wherein said interpolative mura correction is based upon a data set for a single grey level.

17. The display of claim 1 wherein said interpolative mura correction is based upon a data set for a plurality of grey levels.

18. The display of claim 17 wherein said plurality of grey levels is less than all available grey levels.

19. The display of claim 1 wherein said interpolative mura correction is based upon different data sets for different colors.

20. The display of claim 1 wherein said mura correction is generally lower toward the sides and higher toward the center of the display.

21. The method display of claim 1 wherein said gray levels include less than all of the tone scale of said display.

22. The display of claim 1 wherein said backlight has a two dimensional array of light emitting elements.

23. The display of claim 22 wherein each of said light emitting elements is separately controllable in intensity.

24. The display of claim 23 wherein said two dimensional array is a substantially planar array.

25. The display of claim 8 wherein said backlight includes a two dimensional array of light emitting elements, wherein each of said elements is separately controllable.

* * * * *

UNITED STATES PATENT AND TRADEMARK OFFICE

CERTIFICATE OF CORRECTION

PATENT NO. : 8,610,654 B2
APPLICATION NO. : 12/459502
DATED : December 17, 2013
INVENTOR(S) : Louis Joseph Kerofsky et al.

It is certified that error appears in the above-identified patent and that said Letters Patent is hereby corrected as shown below:

In the Claims:

Col. 17, Line 16

Change ""The method display of claim 1" to read --The display of claim 1--.

Signed and Sealed this
Twenty-fourth Day of June, 2014

Michelle K. Lee

Michelle K. Lee
*Deputy Director of the United States Patent and Trademark Office*